US009630794B2

(12) United States Patent
Chiwata et al.

(10) Patent No.: US 9,630,794 B2
(45) Date of Patent: Apr. 25, 2017

(54) SHEET STACKING DEVICE

(71) Applicant: FUJIFILM CORPORATION, Minato-ku, Tokyo (JP)

(72) Inventors: Yuhei Chiwata, Kanagawa (JP); Takayuki Nakamura, Kanagawa (JP); Koji Furukawa, Kanagawa (JP); Shintaro Anzai, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 0 days.

(21) Appl. No.: 15/047,638

(22) Filed: Feb. 19, 2016

(65) Prior Publication Data

US 2016/0167411 A1 Jun. 16, 2016

Related U.S. Application Data

(63) Continuation of application No. PCT/JP2014/067948, filed on Jul. 4, 2014.

(30) Foreign Application Priority Data

Aug. 23, 2013 (JP) ..... 2013-173551

(51) Int. Cl.
*B65H 31/00* (2006.01)
*B65H 29/24* (2006.01)
(Continued)

(52) U.S. Cl.
CPC ..... *B65H 29/245* (2013.01); *B41J 13/0009* (2013.01); *B41J 29/377* (2013.01);
(Continued)

(58) Field of Classification Search
CPC ..... B65H 7/20; B65H 29/00; B65H 29/24; B65H 29/245–29/248; B65H 43/00;
(Continued)

(56) References Cited

U.S. PATENT DOCUMENTS 6,273,417 B1 * 8/2001 Berlingen ..... B65H 29/041 271/183
6,522,841 B2 * 2/2003 Horikoshi ..... B65H 29/14 271/211
(Continued)

FOREIGN PATENT DOCUMENTS

JP H8-143208 A 6/1996
JP H11-292380 A 10/1999
(Continued)

OTHER PUBLICATIONS

International Search Report issued in International Application No. PCT/JP2014/067948 on Sep. 30, 2014.
(Continued)

*Primary Examiner* — Prasad Gokhale
(74) *Attorney, Agent, or Firm* — Solaris Intellectual Property Group, PLLC

(57) ABSTRACT

A sheet stacking device (77) is provided with a sheet discharge platform (76) on which image forming sheets (P), which have been subjected to heating and drying processing after images are formed using ink, are stacked; and a nozzle (162) that blows air to a side surface of a sheet bundle in a horizontal direction. Air is blown to the sheet bundle stacked on the sheet discharge platform (76) while the height of the sheet discharge platform (76) is adjusted by a sheet discharge platform raising and lowering device (100) so that a gap is formed between the sheets in the vertically middle portion of the sheet bundle. According to the sheet stacking device (77), a plurality of image forming sheets (P) can be efficiently cooled on the sheet discharge platform. Accordingly, the occurrence of blocking can be suppressed.

17 Claims, 11 Drawing Sheets

(51) Int. Cl.

| | |
|---|---|
| ***B65H 31/20*** | (2006.01) |
| ***B41J 29/377*** | (2006.01) |
| ***B65H 31/10*** | (2006.01) |
| ***B65H 31/38*** | (2006.01) |
| ***B41J 13/00*** | (2006.01) |
| ***B65H 43/00*** | (2006.01) |

(52) U.S. Cl.
CPC ..... *B65H 29/246* (2013.01); *B65H 31/10* (2013.01); *B65H 31/20* (2013.01); *B65H 31/38* (2013.01); *B65H 43/00* (2013.01); *B65H 2301/5144* (2013.01); *B65H 2406/14* (2013.01); *B65H 2406/352* (2013.01); *B65H 2511/13* (2013.01); *B65H 2515/10* (2013.01); *B65H 2515/112* (2013.01); *B65H 2515/212* (2013.01); *B65H 2553/414* (2013.01); *B65H 2801/31* (2013.01)

(58) Field of Classification Search
CPC ..... B65H 31/00; B65H 31/20; B65H 31/34; B65H 31/38; B65H 31/10; B65H 2406/10; B65H 2406/12; B65H 2406/121; B65H 2406/122; B65H 2406/13; B65H 2406/14; B65H 2406/352; B65H 2301/5144; B65H 2801/31; B41J 29/377
USPC ..... 271/211, 213–215, 217, 221, 223
See application file for complete search history.

(56) References Cited

U.S. PATENT DOCUMENTS

| | | | | |
|---|---|---|---|---|
| 7,661,671 | B2 * | 2/2010 | Yamazaki | B65H 29/246 271/211 |
| 8,152,163 | B2 * | 4/2012 | Kitan | B65H 29/70 271/207 |
| 8,297,748 | B2 * | 10/2012 | Chiwata | B41J 3/60 271/104 |
| 8,727,345 | B2 * | 5/2014 | Konno | B65H 29/00 271/195 |
| 2005/0206068 | A1 * | 9/2005 | Sasaki | B65H 29/246 271/98 |
| 2009/0057983 | A1 * | 3/2009 | Yamazaki | B65H 29/246 271/3.14 |
| 2011/0090279 | A1 * | 4/2011 | Yanagi | B41M 5/0017 347/21 |
| 2012/0026263 | A1 * | 2/2012 | Chiwata | B41J 11/002 347/101 |
| 2012/0073937 | A1 * | 3/2012 | Toya | B65G 59/02 198/617 |
| 2012/0162304 | A1 | 6/2012 | Fujikura | |
| 2013/0004652 | A1 * | 1/2013 | Furukawa | B65H 31/00 427/8 |

FOREIGN PATENT DOCUMENTS

| | | | |
|---|---|---|---|
| JP | 2007-76864 | A | 3/2007 |
| JP | 2008-32765 | A | 2/2008 |
| JP | 2008-100811 | A | 5/2008 |
| JP | 2011-020376 | A | 2/2011 |
| JP | 2012-30913 | A | 2/2012 |
| JP | 2012-135984 | A | 7/2012 |
| JP | 2012-166889 | A | 9/2012 |

OTHER PUBLICATIONS

Written Opinion of the ISA issued in International Application No. PCT/JP2014/067948 on Sep. 30, 2014.
International Preliminary Report on Patentability issued in International Application No. PCT/JP2014/067948 on Mar. 31, 2015.

* cited by examiner

SHEET STACKING DEVICE

CROSS-REFERENCE TO RELATED APPLICATIONS

This application is a continuation application of International Application No. PCT/JP2014/067948, filed Jul. 4, 2014, the disclosure of which is incorporated herein by reference in its entirety. Further, this application claims priority from Japanese Patent Application No. 2013-173551 filed Aug. 23, 2013, the disclosure of which is incorporated herein by reference in its entirety.

BACKGROUND OF THE INVENTION

1. Field of the Invention

The present invention relates to a sheet stacking device that stacks and cools sheets on which images are recorded and which are subjected to heating and drying processing.

2. Description of the Related Art

In ink jet printing where processing is performed at high speed, heating and drying processing is performed on sheets using hot air, an infrared heater, a UV lamp, or the like in order to dry the sheets. However, when the temperature of stacked sheets is high, printed images adhere to adjacent sheets due to the weight of the sheets. For this reason, image defects, such as voids and offsets, that is, so-called blocking may occur.

JP2007-76864A discloses an image forming apparatus that includes cooling means for blowing air to sheets loaded on sheet loading means.

JP2011-020376A discloses an image forming apparatus that blows air to the side surface of a sheet bundle from a lower portion of the sheet bundle to an upper portion thereof to form gaps between the respective sheets and cool the sheets. In this image forming apparatus, a top plate is disposed on sheets and covers the sheets in order to prevent the sheets from being flipped during the blowing of air.

JP2012-30913A discloses an image forming apparatus that separates stacked sheets into sheet bundles by separation members and blows air to the separated sheet bundles.

SUMMARY OF THE INVENTION

However, since air is blown to a top sheet of the stacked sheets from the upper side toward the lower side in the image forming apparatus disclosed in JP2007-76864A, air can be blown to only the top sheet. For this reason, since cooling time per sheet becomes shortened when processing of a sheet is performed at high speed, the cooling of a sheet becomes insufficient.

In the image forming apparatus disclosed in JP2011-020376A, a sheet bundle should be covered with the top plate whenever the sheet bundle is cooled. For this reason, the handling of a sheet is troublesome.

Since the image forming apparatus disclosed in JP2012-30913A requires a plurality of separation members for separating the stacked sheets into a plurality of sheet bundles and a device for moving the separation members, the number of parts is increased and the structure is complicated.

The invention has been made in consideration of the above-mentioned circumstances, and an object of the invention is to provide a sheet stacking device that can suppress blocking by suppressing the fluttering of sheets and efficiently cooling the sheets with a simple structure.

A sheet stacking device according to a first aspect includes: a sheet discharge platform where sheets, which have been subjected to heating and drying processing after images are formed using ink liquid, are conveyed and stacked; a blowing mechanism that includes a nozzle having an opening, a whole surface of the opening being positioned so as to face a portion on a side surface of a sheet bundle stacked on the sheet discharge platform below an upper portion of the sheet bundle by a distance corresponding to a predetermined number of sheets, and the nozzle blowing air to the side surface of the sheet bundle via the opening; and a height adjustment mechanism that changes the position of the sheet discharge platform relative to the nozzle in a vertical direction according to a height of the sheet bundle.

In the sheet stacking device according to the first aspect, sheets, which have been subjected to heating and drying processing after images are formed using ink liquid, are stacked on the sheet discharge platform.

The nozzle of the blowing mechanism blows air to the side surface of the sheet bundle stacked on the sheet discharge platform. Accordingly, air is sent between the sheets of the sheet bundle and can cool the sheets.

Here, the height adjustment mechanism changes the position of the sheet discharge platform relative to the nozzle in a vertical direction according to a height of the sheet bundle. Accordingly, since air is blown to the side surface of the sheet bundle present on the lower side while a predetermined number of sheets present at an upper portion of the sheet bundle serves as a weight, the sheets can be cooled without fluttering.

According to an invention of a second aspect, in the sheet stacking device according to the first aspect, the blowing mechanism is provided on a downstream side of the sheet discharge platform in a conveying direction of the sheet.

Since the blowing mechanism is provided on a downstream side of the sheet discharge platform in a conveying direction of the sheet in the sheet stacking device according to the second aspect, a member provided on the side orthogonal to the conveying direction of the sheet of the sheet bundle does not obstruct the blowing of air and air is easily discharged between the sheets of the sheet bundle. Accordingly, cooling efficiency is improved.

According to an invention of a third aspect, the sheet stacking device according to the first or second aspect further includes a sheet alignment mechanism that aligns the sheet by coming into contact with the side surface of the sheet bundle below the portion to which air is blown from the nozzle.

In the sheet stacking device according to the third aspect, the sheet alignment mechanism aligns the sheet by coming into contact with the side surface of the sheet bundle below the portion to which air is blown from the nozzle. A region, which is positioned below the portion to which air is blown from the nozzle, is a region in which the movement of the sheet caused by the blowing of air after the completion of the blowing of air is not performed. Accordingly, when a sheet is aligned in this region, the alignment accuracy of a sheet can be improved.

According to an invention of a fourth aspect, the sheet stacking device according to the third aspect further includes a height detecting device that detects the height of the sheet bundle stacked on the sheet discharge platform, and a control device that controls the height adjustment mechanism according to the height of the sheet bundle detected by the height detecting device.

In the sheet stacking device according to the fourth aspect, the height detecting device detects the height of the sheet bundle stacked on the sheet discharge platform. The control device controls the height adjustment mechanism according to the height of the sheet bundle, which is detected by the height detecting device, to change the position of the sheet discharge platform relative to the nozzle in the vertical direction. Accordingly, it is possible to automatically change the position of the sheet discharge platform relative to the nozzle in the vertical direction.

According to an invention of a fifth aspect, in the sheet stacking device according to the fourth aspect, the height adjustment mechanism lowers the sheet discharge platform according to an increase in the height of the sheet bundle.

According to the sheet stacking device of the fifth aspect, the height adjustment mechanism lowers the sheet discharge platform according to an increase in the height of the sheet bundle. For this reason, the fluttering of a sheet can be suppressed by simple control while a predetermined number of sheets present at an upper portion of the sheet bundle serves as a weight.

According to an invention of a sixth aspect, in the sheet stacking device according to the fourth aspect, the sheet discharge platform is fixed and the height adjustment mechanism raises the nozzle according to an increase in the height of the sheet bundle.

According to the sheet stacking device of the sixth aspect, the height adjustment mechanism raises the nozzle according to an increase in the height of the sheet bundle. For this reason, the fluttering of a sheet can be suppressed by simple control while a predetermined number of sheets present at an upper portion of the sheet bundle serves as a weight.

According to an invention of a seventh aspect, in the sheet stacking device according to the fourth aspect, the sheet alignment mechanism includes a sheet alignment member that includes an air passage portion allowing air to pass therethrough and aligns the sheet of the sheet bundle by coming into contact with a side surface of the sheet bundle crossing the side surface of the sheet bundle to which air is blown, and an area changing device that changes an air passage area of the air passage portion.

According to the sheet stacking device of the seventh aspect, the sheet alignment member of the sheet alignment mechanism aligns the sheet of the sheet bundle by coming into contact with a side surface of the sheet bundle crossing the side surface of the sheet bundle to which air is blown.

Since the sheet alignment member includes an air passage portion allowing air to pass therethrough, air having passed between the sheets can be discharged to the outside through the air passage portion of the sheet alignment member.

The area changing device can control the amount of air, which is discharged to the outside through the air passage portion, by changing the air passage area of the air passage portion of the sheet alignment member. Accordingly, intervals between the sheets, to which air is blown, near the sheet alignment member can be changed.

According to an invention of an eighth aspect, in the sheet stacking device according to the seventh aspect, the control device controls the area changing device to reduce the air passage area of the air passage portion in a case where the sheets are thick.

According to the sheet stacking device of the eighth aspect, the control device controls the area changing device to reduce the air passage area of the air passage portion in a case where the sheets are thick. Accordingly, since it is possible to suppress the leakage of air, which enters a gap between the sheets of the sheet bundle, to the outside through the air passage portion, a gap can be formed between the sheets.

According to an invention of a ninth aspect, the sheet stacking device according to any one of the first to eighth aspects further includes a blowing fan that blows air to an upper surface of the sheet bundle toward a lower side.

According to the sheet stacking device of the ninth aspect, since the blowing fan blows air to an upper surface of the sheet bundle toward a lower side, wind pressure can be applied to the upper sheet of the sheet bundle. Accordingly, it is possible to make the sheet, which has been curled, flat.

According to an invention of a tenth aspect, in the sheet stacking device according to any one of the fourth to sixth aspects, the control device adjusts a blowing height between an upper end of an opening of the nozzle and an upper surface of the sheet bundle in the range of 4 mm to 20 mm.

According to the sheet stacking device of the tenth aspect, since the control device adjusts a blowing height between an upper end of an opening of the nozzle and an upper surface of the sheet bundle in the range of 4 mm to 20 mm, it is possible to efficiently cool the sheets, to suppress the occurrence of blocking, and to suppress the fluttering of the sheets.

According to an invention of an eleventh aspect, in the sheet stacking device according to any one of the fourth to sixth aspects and the tenth aspect, the height detecting device is a weight sensor that is provided on the sheet discharge platform, and the control device calculates the height of the sheet bundle on the basis of the weight and thickness of the sheet, which are stored in advance, and the weight of the sheet bundle that is measured by the weight sensor.

According to the sheet stacking device of the eleventh aspect, the weight sensor detects the weight of the sheet bundle. The control device can calculate the height of the sheet bundle on the basis of the weight and thickness of the sheet, which are stored in advance, and the weight of the sheet bundle that is measured by the weight sensor.

According to the sheet stacking device of the invention, it is possible to obtain an excellent effect that can suppress blocking by suppressing the fluttering of sheets and efficiently cooling the sheets with a simple structure.

DESCRIPTION OF THE PREFERRED EMBODIMENTS

An example of an image forming apparatus 10, which includes a sheet stacking device 77 according to an embodiment of the invention, will be described with reference to the drawings. Meanwhile, an arrow UP of each drawing indicates an upper side in a vertical direction.

(Entire Structure)

Figure 1:
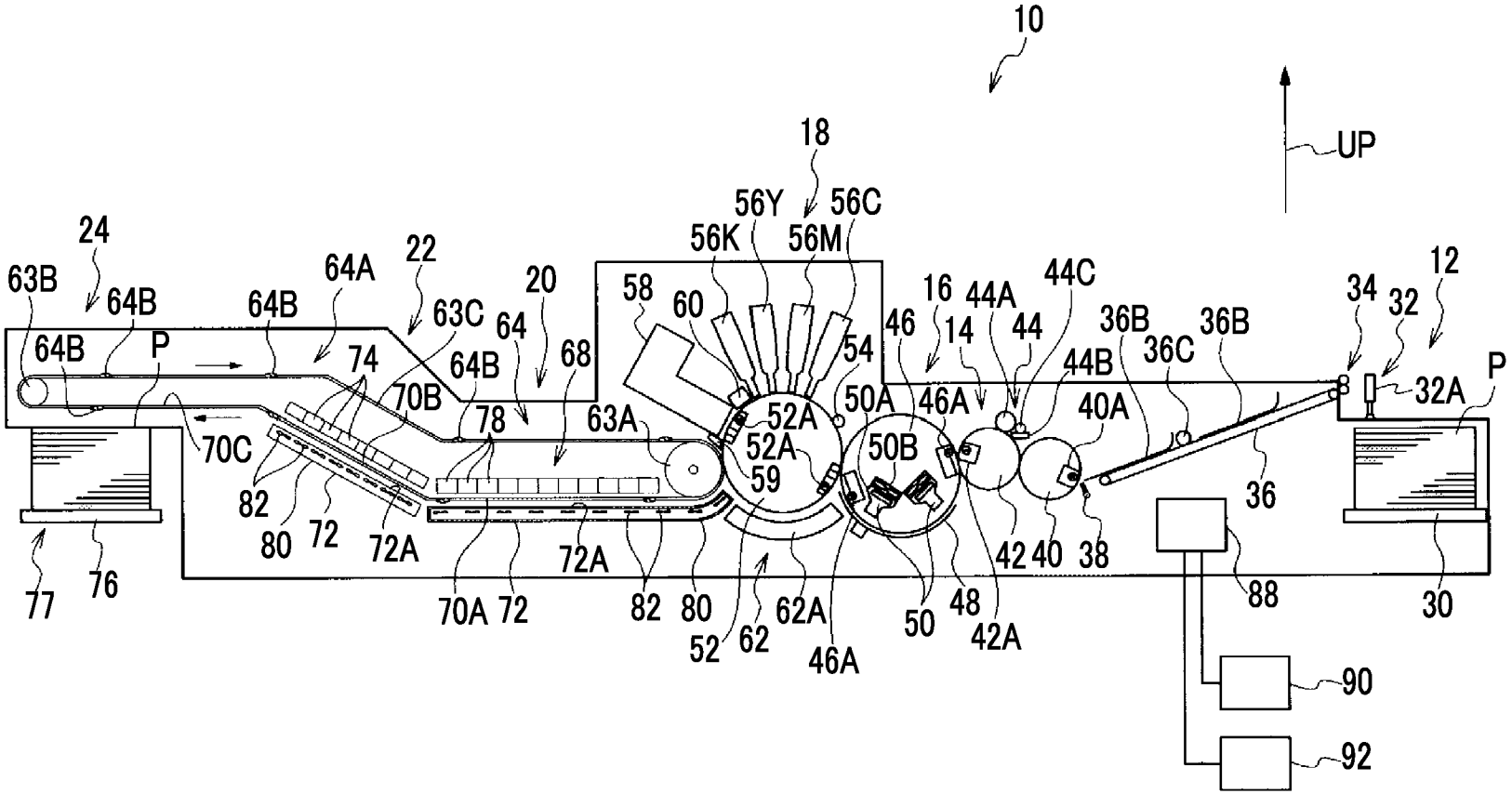
FIG. 1 is a longitudinal sectional view showing the entire structure of an image forming apparatus that includes a sheet stacking device according to an embodiment of the invention.

As shown in FIG. 1, an image forming apparatus 10 according to this embodiment is an apparatus that forms an image on an image forming sheet P as a recording medium with an aqueous UV ink (a UV (ultraviolet) curing ink using an aqueous medium) by an ink jet method. The image forming apparatus 10 mainly includes a sheet feed section 12 that feeds the image forming sheet P, a treatment liquid applying section 14 that applies predetermined treatment liquid to the surface (image recording surface) of the image forming sheet P fed from the sheet feed section 12, a treatment liquid drying section 16 that performs processing for drying the image forming sheet P to which the treatment liquid has been applied by the treatment liquid applying section 14, an image recording section 18 that forms an image on the surface of the image forming sheet P subjected to drying processing by the treatment liquid drying section 16, an ink drying section 20 that performs processing for drying the image forming sheet P on which the image has been formed by the image recording section 18, a UV irradiation processing section 22 that fixes the image to the image forming sheet P by performing UV irradiation processing (fixing processing) on the image forming sheet P subjected to drying processing by the ink drying section 20, and a sheet discharge section 24 that discharges the image forming sheet P subjected to the UV irradiation processing by the UV irradiation processing section 22.

<Sheet Feed Section>

The sheet feed section 12 mainly includes a sheet feed platform 30 on which image forming sheets P are loaded, a sucker device 32 that sends the image forming sheet P, a sheet feed roller 34 that conveys the sent image forming sheet P, a conveying belt 36 that conveys the image forming sheet P, front stopper members 38 that align an end portion of the image forming sheet P, and a sheet feed drum 40 that conveys the image forming sheet P while rotating.

The image forming sheet P, which is used for the image forming apparatus 10 of this embodiment, is so-called coated paper that includes a coating layer formed on a support. Examples of the coated paper include art paper, high-quality coated paper, medium-quality coated paper, high-quality lightweight coated paper, medium-quality lightweight coated paper, a fine coated sheet, and the like.

Examples of the support, which can be suitably used for the image forming sheet P, include chemical pulp, such as leaf bleached kraft pulp (LBKP) and needle bleached kraft pulp (NBKP); mechanical pulp, such as ground pulp (GP), pressure ground wood (PGW), refiner mechanical pulp (RMP), thermo-mechanical pulp (TMP), chemi-thermo mechanical pulp (CTMP), chemi-mechanical pulp (CMP), and chemi-ground pulp (CGP); and stencil paper that is manufactured using a mixture of wood pulp, such as waste paper pulp or de-inked pulp (DIP), and a pigment serving as main components, a binder, and one or more of various additives, such as a sizing agent, a fixing agent, a yield improver, a cationizing agent, and a paper strengthening agent, by various apparatuses, such as a Fourdrinier machine, a cylinder paper machine, and a twin-wire paper making machine.

The basis weight of the support is generally in the range of about 40 g/m$^2$ to 300 g/m$^2$, but is not particularly limited. The image forming sheet P, which is used for the image forming apparatus 10 of this embodiment, is a sheet that includes a coating layer formed on the above-mentioned support. The coating layer is made of a composition to be applied that contains a pigment and a binder as main components, and at least one coating layer is formed on the support.

At least calcium carbonate is contained as the pigment. Meanwhile, the pigment may contain components other than calcium carbonate, for example, inorganic pigments, such as kaolin, talc, sulfuric acidcalcium, barium sulfate, titanium dioxide, zinc oxide, zinc sulfide, zinc carbonate, satin white, aluminum silicate, diatomaceous earth, calcium silicate, magnesium silicate, synthetic amorphous silica, colloidal silica, alumina, colloidal alumina, pseudoboehmite, aluminum hydroxide, lithopone, zeolite, hydrated halloysite, and magnesium hydroxide; and organic pigments, such as a styrene plastic pigment, an acrylic plastic pigment, polyethylene, microcapsule, a urea resin, and a melamine resin.

Examples of the binder can include starch derivatives, such as oxidized starch, etherified starch, and phosphoric-esterified starch; cellulose derivatives, such as carboxymethyl cellulose and hydroxyethyl cellulose; casein, gelatin, soybean protein, polyvinyl alcohol, or a derivative thereof; various derivatives, such as polyvinyl alcohol having various saponification degrees or silanol-modified products thereof, carboxylated products thereof, and cationized products thereof; conjugated diene copolymer latex, such as polyvinylpyrrolidone, a maleic anhydride resin, a styrene-butadiene copolymer, and a methyl methacrylate-butadiene copolymer; acrylic polymer latex, such as polymers or copolymers of acrylic ester and methacrylic ester; vinyl polymer latex, such as an ethylenevinyl acetate copolymer;

functional group-modified polymer latex containing monomers including functional groups, such as carboxy groups of these various polymers; water-based adhesives using thermosetting synthetic resins, such as a melamine resin and a urea resin; acryl such as polymethyl methacrylate; acid ester; resins of polymers or copolymers of methacrylic ester; and synthetic resin adhesives, such as a polyurethane resin, a unsaturated polyester resin, a vinyl chloride-vinyl acetate copolymer, polyvinyl butyral, and a alkyd resin.

Further, for example, various additives, such as a dye fixing agent, a pigment dispersing agent, a thickener, a flow modifier, an anti-foaming agent, a foam inhibitor, a mold release agent, a foaming agent, a penetrating agent, a coloring dye, a coloring pigment, a fluorescent whitening agent, an ultraviolet absorber, an antioxidant, a preservative, an antifungal agent, a water resistant additive, a wet paper strengthening agent, and a dry paper strengthening agent, can be appropriately mixed into the coating layer.

The sheet feed platform 30 is provided with a sheet feed platform raising and lowering device (not shown) that raises and lowers the sheet feed platform 30 so that the height of the uppermost image forming sheet P loaded on the sheet feed platform 30 is constant.

The sucker device 32 includes a suction foot 32A that is provided so as to be capable of being freely raised and lowered and oscillating. The sucker device 32 is adapted to hold the upper surface of the image forming sheet P by the suction of the suction foot 32A and to send the image forming sheet P to the sheet feed roller 34 from the sheet feed platform 30.

Specifically, the suction foot 32A is adapted to hold the upper surface of an end portion of the uppermost image forming sheet P, which is loaded on the sheet feed platform 30, by suction, to lift the image forming sheet P, and to send the end of the lifted image forming sheet P to the sheet feed roller 34.

The conveying belt 36 is disposed and inclined so as to be lowered on the downstream side in a conveying direction of a sheet member, such as the image forming sheet P, (hereinafter, simply referred to as the downstream side in a conveying direction), and guides the image forming sheet P, which is placed on a conveying surface thereof, to the front stopper members 38 along the conveying surface.

Further, a plurality of plate-like retainers 36B for suppressing the floating or irregularity of the image forming sheet P, which is conveyed by the conveying belt 36, are provided above the conveying surface of the conveying belt 36 so as to line up in the conveying direction of the image forming sheet P and the width direction of the image forming sheet P (a direction orthogonal to the conveying direction in which the image forming sheet P is conveyed).

Furthermore, a roller 36C for pressing the image forming sheet P, which is conveyed, against the conveying surface of the conveying belt 36 is provided between one retainer 36B and another retainer 36B that line up in the conveying direction of the image forming sheet P.

The plurality of front stopper members 38 are provided in the width direction of the image forming sheet P (hereinafter, simply referred to as the width direction of the sheet member). Accordingly, when an end portion of the image forming sheet P comes into contact with (is pushed against) the front stopper members 38 that line up in the width direction of the sheet member, the posture of the image forming sheet P is corrected.

In addition, the front stopper members 38 are provided with oscillating devices (not shown) that oscillate the front stopper members 38 so that the image forming sheet P of which the posture has been corrected is delivered to the rotating sheet feed drum 40.

The sheet feed drum 40 is formed in a cylindrical shape and is provided with a driving source (not shown) that rotates the sheet feed drum 40. Moreover, a gripper 40A for holding an end portion of the image forming sheet P, which is conveyed, is provided on the outer peripheral surface of the sheet feed drum 40.

According to this structure, when the sheet feed drum 40 holds the end portion of the image forming sheet P by the gripper 40A and rotates, the sheet feed drum 40 conveys the image forming sheet P to the treatment liquid applying section 14 while winding the image forming sheet P on the peripheral surface thereof.

<Treatment Liquid Applying Section>

The treatment liquid applying section 14 mainly includes a treatment liquid applying drum 42 that conveys the image forming sheet P, and a treatment liquid applying unit 44 as an example of a treatment liquid applying member for applying treatment liquid, which allows a coloring material (pigment particle) contained in a droplet (ink liquid) to aggregate, to the surface of the image forming sheet P conveyed by the treatment liquid applying drum 42.

The treatment liquid applying drum 42 is formed in a cylindrical shape and is provided with a driving source (not shown) that rotates the treatment liquid applying drum 42. Moreover, a gripper 42A for holding an end portion of the image forming sheet P, which is conveyed, is provided on the outer peripheral surface of the treatment liquid applying drum 42.

According to this structure, when the treatment liquid applying drum 42 holds the end portion of the image forming sheet P, which is delivered from the sheet feed drum 40, by the gripper 42A and rotates, the treatment liquid applying drum 42 conveys the image forming sheet P to the treatment liquid drying section 16 while winding the image forming sheet P on the peripheral surface thereof.

The treatment liquid applying unit 44 mainly includes an applying roller 44A that applies treatment liquid to the image forming sheet P, a treatment liquid tank 44B in which treatment liquid is stored, and a drawing-up roller 44C that draws up the treatment liquid stored in the treatment liquid tank 44B to supply the treatment liquid to the applying roller 44A. According to this structure, the treatment liquid applying unit 44 applies treatment liquid to the surface of the image forming sheet P, which is conveyed by the treatment liquid applying drum 42, by the roller.

(Treatment Liquid)

The treatment liquid contains an aggregating agent that allows a component contained in ink liquid to aggregate.

The aggregating agent may be a compound that can change the pH of the ink liquid, multivalent metal salt, or polyallylamines. In this embodiment, in terms of the aggregability of the ink liquid, the aggregating agent is preferably a compound that can change the pH of the ink liquid, and is more preferably a compound that can lower the pH of the ink liquid. Acid materials having high water solubility (a phosphoric acid, an oxalic acid, a malonic acid, a citric acid, derivatives of compounds thereof, salts thereof, and the like) may be suitably used as the compound that can lower the pH of the ink liquid.

As described above, the aggregating agent is preferably an acid material having high water solubility. In terms of the improvement of aggregability and the fixing of the entire ink, the aggregating agent is preferably an organic acid and more preferably a divalent or higher organic acid. Further, it is particularly preferable that the aggregating agent is a divalent or higher and trivalent or lower acid material. The divalent or higher organic acid is preferably an organic acid having a first acid dissociation constant pKa of 3.5 or less, and is more preferably an organic acid having a first acid dissociation constant pKa of 3.0 or less. Specifically, a phosphoric acid, an oxalic acid, a malonic acid, a citric acid, and the like may be suitably used as the divalent or higher organic acid.

As the aggregating agent, one kind of an acid material may be used alone and two or more kinds of acid materials may be used together. Accordingly, aggregability can be improved and the entire ink can be fixed. The content of the aggregating agent, which allows ink liquid to aggregate, in the treatment liquid is preferably in the range of 1 mass % to 50 mass %, more preferably in the range of 3 mass % to 45 mass %, and even more preferably in the range of 5 mass % to 40 mass %. Further, it is preferable that the pH (25° C.) of the ink liquid is 8.0 or more and the pH (25° C.) of the treatment liquid is in the range of 0.5 to 4. Accordingly, the density and resolution of an image and the speed of ink jet recording can be improved.

Further, other additives can be added to the treatment liquid. Examples of the additives include known additives, such as a drying inhibitor (a wetting agent), a fading inhibitor, an emulsion stabilizer, a penetration enhancer, an ultraviolet absorber, a preservative, an antifungal agent, a pH adjuster, a surface tension adjuster, an anti-foaming agent, a viscosity modifier, a dispersing agent, a dispersion stabilizer, a rust inhibitor, and a chelating agent.

<Treatment Liquid Drying Section>

The treatment liquid drying section 16 mainly includes a treatment liquid drying drum 46 that conveys the image forming sheet P, a sheet conveying guide 48 that is curved along the outer surface of the treatment liquid drying drum 46, and treatment liquid drying processing units 50 as examples of treatment liquid drying members for blowing hot air to the surface of the image forming sheet P, which is conveyed by the treatment liquid drying drum 46, to dry the treatment liquid.

The treatment liquid drying drum 46 is formed in a cylindrical shape and is provided with a driving source (not shown) that rotates the treatment liquid drying drum 46. Moreover, grippers 46A for holding end portions of the image forming sheets P, which are conveyed, are provided on the outer peripheral surface of the treatment liquid drying drum 46.

According to this structure, when the treatment liquid drying drum 46 holds the end portion of the image forming sheet P, which is delivered from the treatment liquid applying drum 42, by the gripper 46A and rotates, the treatment liquid drying drum 46 conveys the image forming sheet P to the image recording section 18 while winding the image forming sheet P on the peripheral surface thereof.

Two treatment liquid drying processing units 50 are disposed in the treatment liquid drying drum 46. Each of the treatment liquid drying processing units 50 includes a heater 50A and a fan 50B that are provided therein. The fan 50B blows air, which is warmed up by the heater 50A, to the surface of the image forming sheet P.

<Image Recording Section>

The image recording section 18 mainly includes: an image recording drum 52 that conveys the image forming sheet P; a pressing roller 54 that presses the image forming sheet P conveyed by the image recording drum 52 to allow the image forming sheet P to come into close contact with the peripheral surface of the image recording drum 52; recording heads 56C, 56M, 56Y, and 56K as examples of image forming members that eject droplets (ink droplets) having colors of cyan C, magenta M, yellow Y, and black K to the image forming sheet P; an in-line sensor 58 that reads information about images formed on the image forming sheet P; a mist filter 60 that catches ink mist; and a drum cooling unit 62 that cools the image recording drum 52. Meanwhile, when the respective colors corresponding to the recording heads 56C, 56M, 56Y, and 56K do not need to be distinguished from each other in the following description, reference characters C, M, Y, and K will be omitted and the recording heads 56C, 56M, 56Y, and 56K will be simply written as the recording heads 56.

The image recording drum 52 is formed in a cylindrical shape and is provided with a driving source (not shown) that rotates the image recording drum 52. Moreover, grippers 52A for holding end portions of the image forming sheets P, which are conveyed, are provided on the outer peripheral surface of the image recording drum 52.

According to this structure, when the image recording drum 52 holds the end portion of the image forming sheet P, which is delivered from the treatment liquid drying drum 46, by the gripper 52A and rotates, the image recording drum 52 conveys the image forming sheet P to the ink drying section 20 while winding the image forming sheet P on the peripheral surface thereof.

Meanwhile, since the grippers 52A are provided at two positions on the outer peripheral surface of the image recording drum 52 of this embodiment and the grippers 46A are provided at two positions on the outer peripheral surfaces of the above-mentioned treatment liquid drying drum 46, each of the image recording drum 52 and the treatment liquid drying drum 46 is adapted to be capable of conveying two image forming sheets P per rotation.

Further, a plurality of suction holes (not shown) are formed on the peripheral surface of the image recording drum 52. Since air is sucked through the suction holes, the image forming sheet P, which is wound on the peripheral surface of the image recording drum 52, is conveyed while being held on the peripheral surface of the image recording drum 52 by suction.

The pressing roller 54 is disposed near a sheet member receiving position of the image recording drum 52 (a position where the image recording drum 52 receives the image forming sheet P from the treatment liquid drying drum 46). The pressing roller 54 is formed of a rubber roller, and is disposed so as to be pressed against the peripheral surface of the image recording drum 52. Accordingly, the image forming sheet P is made to come into close contact with the peripheral surface of the image recording drum 52 by passing between the pressing roller 54 and the image recording drum 52.

The respective recording heads 56 are disposed at regular intervals on the downstream side of the pressing roller 54 in the conveying direction, and each recording head is formed of a full-line head corresponding to the width of the sheet member. In addition, each recording head 56 is provided with a nozzle face (not shown) on which nozzles for ejecting droplets are formed and which faces the peripheral surface of the image recording drum 52.

(Ink Liquid)

Aqueous UV ink is used as the ink liquid that is to be ejected from each recording head 56. The aqueous UV ink is ink that is to be cured by the irradiation of ultraviolet light (UV) after being ejected.

The ink liquid of this embodiment contains a pigment, and can be formed using a dispersing agent, a surfactant, and other components as necessary. The ink liquid contains at least one kind of a pigment as a component of a coloring material. The pigment is not particularly limited, and can be appropriately selected according to the purpose. For example, any one of an organic pigment and an inorganic pigment may be used. Since the pigment is almost insoluble in water or hardly soluble in water, the pigment is preferable in terms of the colorability and durability of ink. Further, it is preferable that the pigment is a water-dispersible pigment of which at least a part of the surface is covered with a polymer dispersing agent.

The ink liquid of this embodiment may contain at least one kind of a dispersing agent. Any one of a polymer dispersing agent and a low-molecular-weight surfactant-type dispersing agent may be used as the dispersing agent for the pigment. Furthermore, any one of a water-soluble dispersing agent and a water-insoluble dispersing agent may be used as the polymer dispersing agent.

The weight-average molecular weight of the polymer dispersing agent is preferably in the range of 3,000 to 100,000, more preferably in the range of 5,000 to 50,000, even more preferably in the range of 5,000 to 40,000, and particularly preferably in the range of 10,000 to 40,000.

It is preferable that the acid value of the polymer dispersing agent is 100 KOHmg/g or less in terms of excellent aggregability when treatment liquid comes into contact with the polymer dispersing agent. In addition, the acid value is more preferably in the range of 25 KOHmg/g to 100 KOHmg/g, even more preferably in the range of 25 KOHmg/g to 80 KOHmg/g, and particularly preferably in the range of 30 KOHmg/g to 65 KOHmg/g. When the acid value of the polymer dispersing agent is 25 or more, the stability of self-dispersibility is excellent.

Meanwhile, the oxidation of a polymer was obtained by a method disclosed in JIS (JIS K0070: 1992).

In terms of self-dispersibility and an aggregation rate, which is obtained when the treatment liquid comes into contact with the polymer dispersing agent, the polymer dispersing agent preferably contains a polymer including a carboxyl group and more preferably contains a polymer including a carboxyl group and having an acid value in the range of 25 KOHmg/g to 80 KOHmg/g.

In this embodiment, in terms of the light resistance, the quality, and the like of an image, the ink liquid preferably contains a pigment and a dispersing agent, more preferably contains an organic pigment and a polymer dispersing agent, and particularly preferably contains an organic pigment and a polymer dispersing agent including a carboxyl group. Further, in terms of aggregability, it is preferable that the pigment is covered with a polymer dispersing agent including a carboxyl group and is insoluble in water. Furthermore, in terms of aggregability, it is preferable that the acid value of a particle of a self-dispersing polymer to be described below is smaller than the acid value of the polymer dispersing agent.

The mean particle size of the pigment is preferably in the range of 10 nm to 200 nm, more preferably in the range of 10 nm to 150 nm, and even more preferably in the range of 10 nm to 100 nm. Since color reproducibility is excellent when the mean particle size of the pigment is 200 nm or less, ejection characteristics, which are obtained when ink is ejected by an ink jet method, are excellent. When the mean particle size of the pigment is 100 nm or less, light resistance is excellent. Further, the particle size distribution of the coloring material is not particularly limited, and may be any one of wide particle size distribution and monodisperse particle size distribution. Furthermore, a mixture of two or more kinds of coloring materials having monodisperse particle size distribution may be used.

Meanwhile, the mean particle size and the particle size distribution of the coloring material (pigment particle) are obtained from the measurement of a volume average particle size using a nanotrac particle size distribution measuring device UPA-EX150 (manufactured by Nikkiso Co., Ltd.) and a dynamic light scattering method.

One kind of a pigment may be used alone and a combination of two or more kinds of pigments may be used. In terms of the density of an image, the content of the pigment in the ink liquid is preferably in the range of 1 mass % to 25 mass %, more preferably in the range of 2 mass % to 20 mass %, even more preferably in the range of 5 mass % to 20 mass %, and particularly preferably in the range of 5 mass % to 15 mass % with respect to the ink liquid.

The ink liquid of this embodiment may contain at least one kind of a polymer particle. The polymer particle has a function to aggregate by being unstably dispersed when the polymer particle comes into contact with treatment liquid to be described below or a region where the treatment liquid is dried, and to fix the ink liquid by thickening ink liquid. Accordingly, the polymer particle can further improve the fixability of the ink liquid to the recording medium and the scratch resistance of an image.

A polymer particle having anionic surface charges is used to react with an aggregating agent, and widely and generally known latex is used in a range where sufficient reactivity and ejection stability are obtained. However, it is particularly preferable that a self-dispersing polymer particle is used.

It is preferable that the ink liquid of this embodiment contains at least one kind of a self-dispersing polymer particle as the polymer particle. The self-dispersing polymer has a function to aggregate by being unstably dispersed when the self-dispersing polymer comes into contact with treatment liquid to be described below or a region where the treatment liquid is dried, and to fix the ink liquid by thickening ink liquid. Accordingly, the self-dispersing polymer can further improve the fixability of the ink liquid to the recording medium and the scratch resistance of an image. Furthermore, the self-dispersing polymer is a resin particle that is preferable in terms of not only ejection stability but also liquid stability (particularly, dispersion stability) of a system containing the pigment.

A particle of the self-dispersing polymer means a particle of a water-insoluble polymer that can be dispersed in an aqueous medium by a functional group (particularly, an acidic group or the salt thereof) included in the polymer, when other surfactants are not present, and does not contain a free emulsifier.

A self-dispersing polymer is described in detail in Paragraph Nos. "0063" to "0088" of JP2010-69805A, and the self-dispersing polymer described here can be suitably used in the invention.

It is preferable that the acid value of the self-dispersing polymer of this embodiment is 50 KOHmg/g or less in terms of excellent aggregability when treatment liquid comes into contact with the self-dispersing polymer. Moreover, the acid value of the self-dispersing polymer is more preferably in the range of 25 KOHmg/g to 50 KOHmg/g and even more preferably in the range of 30 KOHmg/g to 50 KOHmg/g. When the acid value of the self-dispersing polymer is 25 KOHmg/g or more, the stability of self-dispersibility is excellent.

In terms of self-dispersibility and an aggregation rate, which is obtained when the treatment liquid comes into contact with the particle of the self-dispersing polymer, the particle of the self-dispersing polymer of this embodiment preferably contains a polymer including a carboxyl group, more preferably contains a polymer including a carboxyl group and having an acid value in the range of 25 KOHmg/g to 50 KOHmg/g, and even more preferably contains a polymer including a carboxyl group and having an acid value in the range of 30 KOHmg/g to 50 KOHmg/g.

The weight-average molecular weight of a water-insoluble polymer forming the particle of the self-dispersing polymer is preferably in the range of 3,000 to 200,000, more preferably in the range of 5,000 to 150,000, and even more preferably in the range of 10,000 to 100,000. When the weight-average molecular weight of the water-insoluble polymer is set to 3,000 or more, the amount of a water-soluble component can be effectively suppressed. Further, when the weight-average molecular weight of the water-insoluble polymer is set to 200,000 or less, the stability of self-dispersibility can be improved.

Meanwhile, the weight-average molecular weight is measured by gel permeation chromatography (GPC). HLC-8220GPC (manufactured by Tosoh Corporation) is used as the GPC; three TSKgeL SuperHZM-H, TSKgeL SuperHZ4000, TSKgeL SuperHZ2000 (manufactured by Tosoh Corporation, 4.6 mm ID×15 cm) are used as columns; and THF (tetrahydrofuran) is used as eluent. Further, as conditions, the concentration of a sample is 0.35/min., the flow rate of the sample is 0.35 ml/min., the amount of the sample to be injected is 10 μl, and measured temperature is 40° C. and is measured by an IR detector.

Furthermore, a calibration curve is made from eight samples, that is, "standard sample TSK standard, polystyrene", "F-40", "F-20", "F-4", "F-1", "A-5000", "A-2500", "A-1000", and "n-propylbenzene" manufactured by Tosoh Corporation.

The volume average particle size of the self-dispersing polymer is preferably in the range of 10 nm to 400 nm, more preferably in the range of 10 nm to 200 nm, and even more preferably in the range of 10 nm to 100 nm. When the volume average particle size of the self-dispersing polymer is 10 nm or more, production suitability is improved. When the volume average particle size of the self-dispersing polymer is 1 μm or less, preservation stability is improved.

Meanwhile, the mean particle size and the particle size distribution of the self-dispersing polymer are obtained from the measurement of a volume average particle size using a nanotrac particle size distribution measuring device UPA-EX150 (manufactured by Nikkiso Co., Ltd.) and a dynamic light scattering method.

One kind of a particle of a self-dispersing polymer may be used alone, and a mixture of two or more kinds of particles of self-dispersing polymers may be used. In terms of an aggregation rate or the glossiness or the like of an image, the content of the particle of the self-dispersing polymer in the ink liquid is preferably in the range of 1 mass % to 30 mass % and more preferably in the range of 5 mass % to 15 mass % with respect to the ink liquid.

Further, a ratio of the content of the particle of a pigment to the content of the particle of the self-dispersing polymer in the ink liquid (for example, the particle of a water-insoluble pigment/the particle of the self-dispersing polymer) is preferably in the range of 1/0.5 to 1/10 and more preferably in the range of 1/1 to 1/4 in terms of the scratch resistance of an image and the like.

The ink liquid of this embodiment may contain at least one kind of a water-soluble polymerizable compound that is polymerized by an active energy ray.

In terms of not obstructing the reaction to an aggregating agent, a pigment, and a polymer particle, it is preferable that a nonionic or cationic polymerizable compound is used as the polymerizable compound. Further, water solubility means a property that a material can be dissolved in water at a predetermined concentration or more, and the polymerizable compound may have only to be dissolved in aqueous ink (preferably, uniformly). Furthermore, since solubility is improved when a water-soluble organic solvent is added to the ink, the polymerizable compound may be dissolved in the ink (preferably, uniformly). Specifically, the solubility of the polymerizable compound in water is preferably 10 mass % or more and more preferably 15 mass % or more.

In terms of not obstructing the reaction to an aggregating agent, a pigment, and a polymer particle, it is preferable that a nonionic or cationic polymerizable compound is used as the polymerizable compound and it is preferable that a polymerizable compound of which the solubility in water having a temperature of 25° C. is 10 mass % or more (particularly, 15 mass % or more) is used as the polymerizable compound.

In terms of the improvement of scratch resistance, it is preferable that a polyfunctional monomer or a difunctional to hexafunctional monomer is used as the polymerizable compound of this embodiment. In terms of compatibility between solubility and scratch resistance, it is preferable that a difunctional to tetrafunctional monomer is used as the polymerizable compound of this embodiment. One kind of a polymerizable compound may be contained alone, and a combination of two or more kinds of polymerizable compounds may be contained.

The content of the polymerizable compound in the ink liquid is preferably in the range of 30 mass % to 300 mass % and more preferably in the range of 50 mass % to 200 mass % with respect to a total solid content of the particles of the pigment and the particles of the self-dispersing polymer. Since image intensity is improved when the content of the polymerizable compound is 30 mass % or more, the scratch resistance of an image is excellent. When the content of the polymerizable compound is 300 mass % or less, it is advantageous in terms of pile height.

At least one of the ink liquid and the treatment liquid further contains an initiator that starts to polymerize a polymerizable compound by an active energy ray.

The ink liquid of this embodiment may contain at least one kind of an initiator that is contained or is not contained in the treatment liquid and starts to polymerize a polymerizable compound by an active energy ray. One kind of a photopolymerization initiator may be used alone, a mixture of two or more kinds of photopolymerization initiators may be used, or a photopolymerization initiator can be used together with a sensitizer.

The initiator may appropriately and selectively contain a compound that can start a polymerization reaction by an active energy ray, and for example, an initiator (for example, a photopolymerization initiator or the like), which generates active species (radicals, acids, bases, or the like) by radiation, light, or an electron beam, can be used.

When an initiator is contained in the ink liquid, the content of the initiator in the ink liquid is preferably in the range of 1 mass % to 40 mass % and more preferably in the range of 5 mass % to 30 mass % with respect to the polymerizable compound. When the content of the initiator is 1 mass % or more, the scratch resistance of an image is further improved and it is advantageous in terms of high-speed recording. When the content of the initiator is 40 mass % or less, it is advantageous in terms of ejection stability.

The ink liquid of this embodiment may contain at least one kind of a water-soluble organic solvent. When the ink liquid contains a water-soluble organic solvent, an effect of preventing ink from being dried and an effect of facilitating the wetting or penetration of ink can be obtained. Since ink liquid adheres to an ink outlet of a spray nozzle and is dried so as to form an aggregate, a water-soluble organic solvent is used as a drying inhibitor for preventing clogging. It is preferable that a water-soluble organic solvent of which vapor pressure is lower than the vapor pressure of water is used for the prevention of the drying of ink and the wetting of ink. Further, a water-soluble organic solvent is used as a penetration enhancer that improves the penetration of ink into paper.

It is preferable that a water-soluble organic solvent of which vapor pressure is lower than the vapor pressure of water is used as the drying inhibitor. One kind of a drying inhibitor may be used alone and two or more kinds of drying inhibitors may be used together. It is preferable that the content of the drying inhibitor in the ink liquid is in the range of 10 mass % to 50 mass %.

The ink liquid contains water, but the amount of water is not particularly limited. Especially, the content of water is preferably in the range of 10 mass % to 99 mass %, more preferably in the range of 30 mss % to 80 mass %, and even more preferably in the range of 50 mass % to 70 mass %.

The ink liquid of this embodiment may be formed using additives other than the above-mentioned components. Examples of other additives include known additives, such as a drying inhibitor (a wetting agent), a fading inhibitor, an emulsion stabilizer, a penetration enhancer, an ultraviolet absorber, a preservative, an antifungal agent, a pH adjuster, a surface tension adjuster, an anti-foaming agent, a viscosity modifier, a dispersing agent, a dispersion stabilizer, a rust inhibitor, and a chelating agent.

As shown in FIG. 1, the in-line sensor 58 is disposed with a predetermined interval interposed between itself and the recording heads 56 on the downstream side of the recording heads 56 in the conveying direction, and reads information about images that are formed on the image forming sheet P by the recording heads 56 corresponding to the respective colors. Further, a contact prevention plate 59, which prevents the image forming sheet P from coming into contact with the in-line sensor 58, is installed on the downstream side of the in-line sensor 58 in the conveying direction. The contact prevention plate 59 prevents the image forming sheet P from coming into contact with the in-line sensor 58 in a case where the image forming sheet P floats due to a conveyance failure or the like.

The mist filter 60 is disposed between the recording heads 56 and the in-line sensor 58, and sucks air around the image recording drum 52 and catches ink mist. Accordingly, the entry of ink mist into the in-line sensor 58 is suppressed so that the occurrence of a reading failure or the like is prevented.

The drum cooling unit 62 is provided so as to face the lower peripheral surface of the image recording drum 52, and mainly includes an air conditioner (not shown) and a duct 62A that guides cold air supplied from the air conditioner to the peripheral surface of the image recording drum 52.

<Ink Drying Section>

The ink drying section 20 mainly includes a chain gripper 64 as an example of a conveying member that conveys the image forming sheet P on which images are formed, suction plates 72 that apply tension to the image forming sheet P conveyed by the chain gripper 64, and an ink drying processing unit 68 that performs processing for drying the image forming sheet P conveyed by the chain gripper 64.

The chain gripper 64 includes chain bodies 64A. Each of the chain bodies 64A includes a first sprocket 63A that is installed close to the image recording drum 52, a second sprocket 63B that is installed in the sheet discharge section 24 and is rotatable, an endless chain 63C that is wound on the first and second sprockets 63A and 63B, and a plurality of chain guides (not shown) that guide the travel of the chain 63C. Further, the first sprocket 63A is provided with a driving source (not shown) that rotates the first sprocket 63A.

Two chain bodies 64A are provided at an interval in the width direction of the image forming sheet P so as to make a pair. A plurality of grippers 64B as examples of holding members, each of which holds an end portion of image forming sheet P to be conveyed, are provided across the pair of chain bodies 64A (see FIGS. 1 and 2A).

That is, the chain gripper 64 includes the pair of chain bodies 64A and the plurality of grippers 64B.

Chain guides (not shown) are disposed at predetermined positions, and guide the chain 63C so that the chain 63C can travel along a predetermined path. In the image forming apparatus 10 of this embodiment, the second sprocket 63B is provided at a position higher than the position of the first sprocket 63A. For this reason, a travel path along which the chain 63C is inclined in the middle thereof is formed. Specifically, the path of the chain 63C includes a first horizontal conveying path 70A of which the height is the same as the height of the first sprocket 63A, an inclined conveying path 70B, and a second horizontal conveying path 70C of which the height is the same as the height of the second sprocket 63B. For this reason, the chain guides are provided at intersections between the respective paths at which a travel direction is changed.

The suction plates 72 are provided along the conveying path along which the image forming sheet P is conveyed by the chain gripper 64. Specifically, the suction plates 72 are disposed along the chain 63C that travels along the first horizontal conveying path 70A and the inclined conveying path 70B.

Further, fans 82 are provided in the suction plates 72, and a suction force for sucking the back of the image forming sheet P is generated on suction surfaces 72A (surfaces facing the chain gripper 64) of the suction plates 72.

Accordingly, since the image forming sheet P, which is conveyed while an end portion of the image forming sheet P is held by the chain gripper 64, is conveyed while coming into slide contact with the suction surfaces 72A of the suction plates 72, tension is generated on the image forming sheet P.

Furthermore, the ink drying processing unit 68 includes a plurality of infrared heaters 78. The plurality of infrared heaters 78 are disposed on the side opposite to the suction plate 72, which is disposed on the first horizontal conveying path 70A, with the image forming sheet P, which is conveyed, interposed between themselves and the suction plate 72; and blow hot air to the surface of the image forming sheet P, which is conveyed, to heat and dry the image forming sheet P.

Meanwhile, the details of the structure of the ink drying section 20 will be described below.

<UV Irradiation Processing Section>

The UV irradiation processing section 22 includes UV irradiation units 74 as examples of ultraviolet lamps for irradiating the image forming sheet P, which is conveyed by the chain gripper 64, with ultraviolet rays. Accordingly, the UV irradiation units 74 irradiate the images, which are formed on the image forming sheet P, with ultraviolet (UV) rays to fix the images to the image forming sheet P.

<Sheet Discharge Section>

Figure 2A:
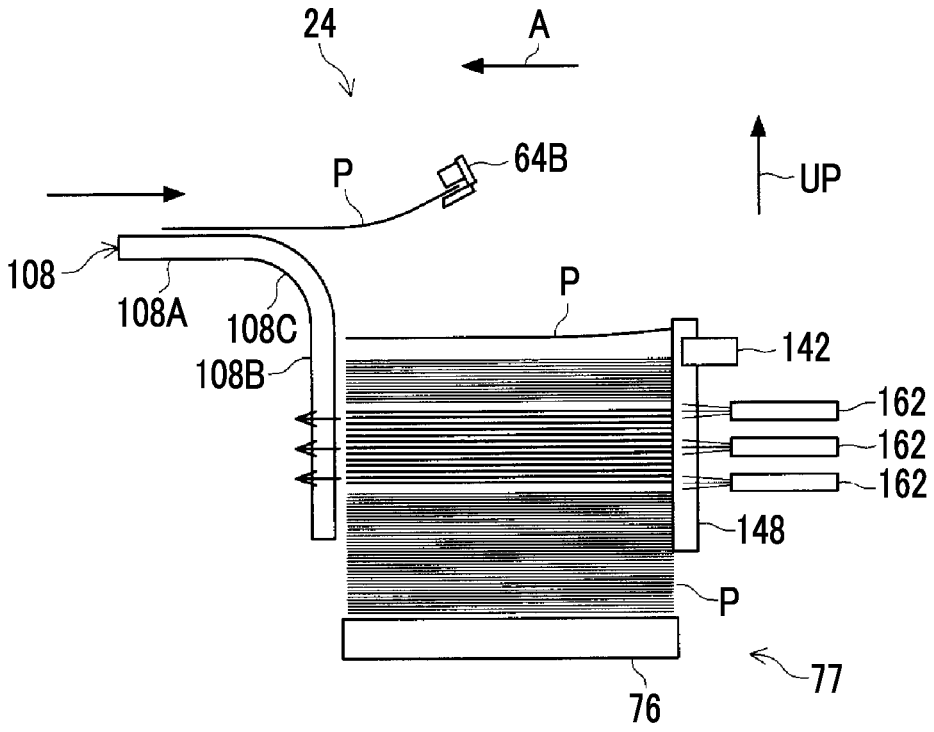
FIG. 2A is a side view of the sheet stacking device according to the embodiment of the invention and FIG. 2B is a side view of a sheet discharge platform raising and lowering device that is provided in the sheet stacking device.

As shown in FIGS. 1 and 2A, the sheet discharge section 24 is provided with the sheet stacking device 77. The sheet stacking device 77 includes a sheet discharge platform 76 on which the image forming sheet P, which is irradiated with UV rays and is released from the gripper 64B, is stacked in a vertical direction and recovered.

Figure 2B:
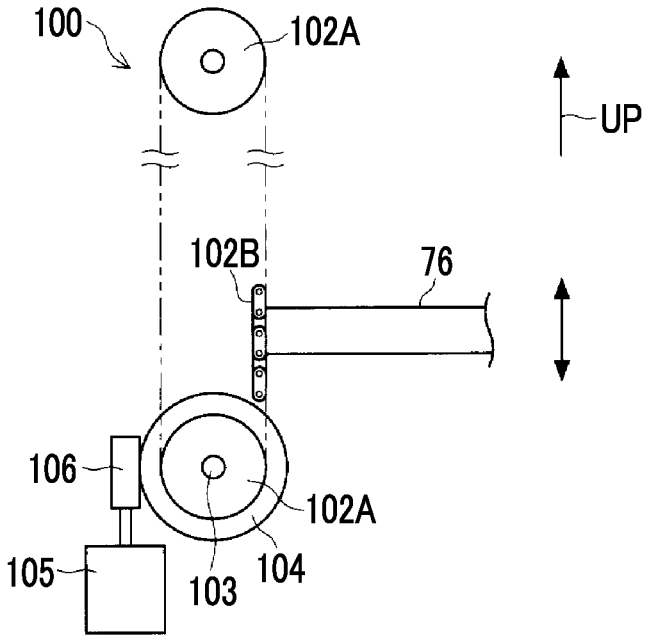

As shown in FIG. 2B, a sheet discharge platform raising and lowering device 100, which changes a height, is connected to the sheet discharge platform 76. The sheet discharge platform raising and lowering device 100 includes an endless chain 102B that is wound on a pair of sprockets 102A. A worm wheel 104 is connected to one sprocket 102A by a shaft 103. A worm 106, which is rotated by a motor 105, meshes with the worm wheel 104. Meanwhile, the driving of the motor 105 is controlled by a control device 88 shown in FIG. 1.

Figure 3:
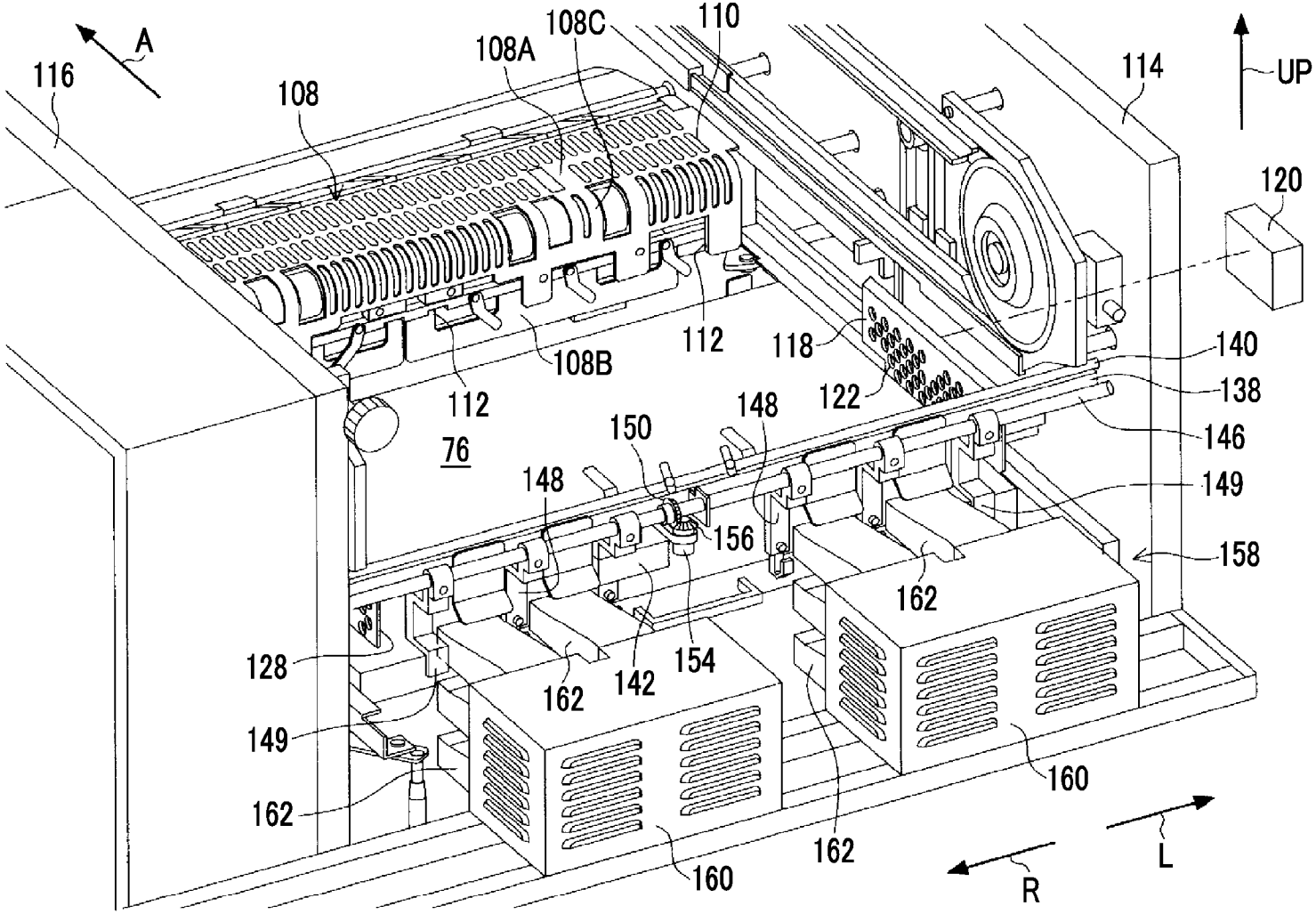
FIG. 3 is a perspective view showing the entire structure of the sheet stacking device.

As shown in FIGS. 2A and 3, a guide plate 108 formed of a plate material is disposed on the side of the sheet discharge platform 76 facing the UV irradiation processing section (the side indicated by an arrow A). The guide plate 108 includes a horizontal portion 108A that is horizontally disposed and a sheet back guide 108B that is disposed on the side of the horizontal portion 108A facing the sheet discharge platform 76 and extends vertically. Meanwhile, the horizontal portion 108A and the sheet back guide 108B are smoothly connected to each other by an arc portion 108C.

As shown in FIG. 3, a plurality of slits 110 are formed at the horizontal portion 108A and the arc portion 108C, and a plurality of air vent openings 112 are formed at the sheet back guide 108B at intervals in a lateral direction.

In FIG. 3, a first side wall frame 114 is disposed on the side, which is indicated by an arrow L, of the sheet discharge platform 76 and a second side wall frame 116 is disposed on the side, which is indicated by an arrow R, of the sheet discharge platform 76.

The motor 105 (see FIGS. 2A and 2B) of the above-mentioned sheet discharge platform raising and lowering device 100 is mounted on the first side wall frame 114.

Further, a first side jogger 118, which comes into contact with an end portion of the image forming sheet P to be stacked on the sheet discharge platform 76 to align the positions of the image forming sheet P in a direction of the arrow R and a direction of the arrow L, and a side jogger driving mechanism 120, which moves the first side jogger 118 in directions where the first side jogger 118 approaches and is away from the image forming sheet P (the direction of the arrow R and the direction of the arrow L), are provided on the side, which faces the first side wall frame 114, of the sheet discharge platform 76. The structure of the side jogger driving mechanism 120 is not particularly limited, and a linear actuator, a cam mechanism, a link mechanism, a rack-and-pinion mechanism, and the like can be used.

Figure 4:
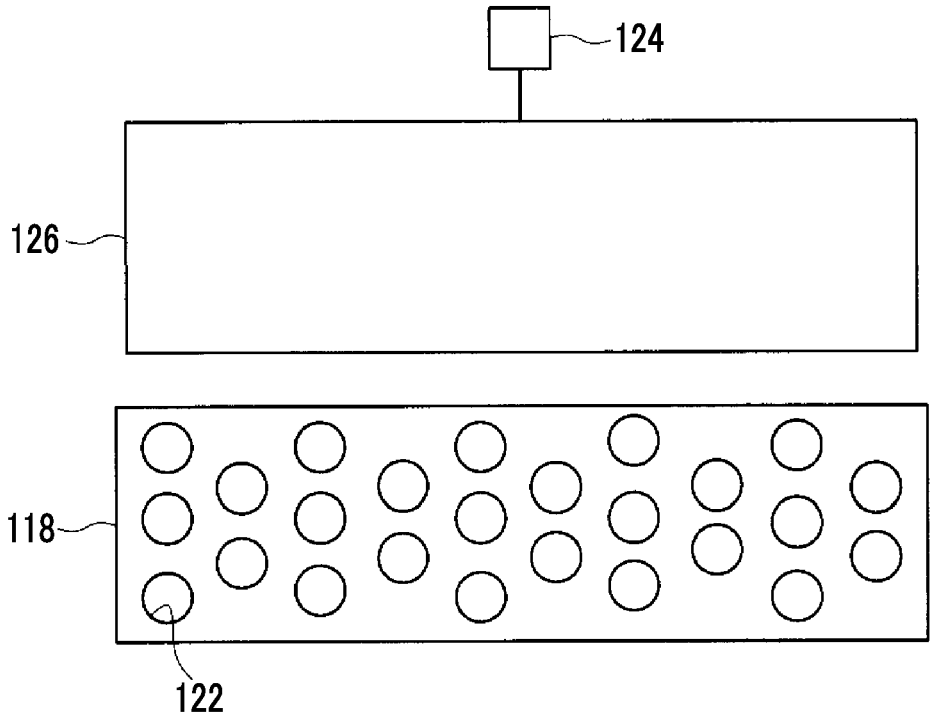
FIG. 4 is a front view of a first side jogger and a first shutter.

As shown in FIG. 4, the first side jogger 118 is formed in the shape of a rectangular plate that is elongated in a lateral direction, and a plurality of air vents 122 are formed at the first side jogger 118 in a longitudinal direction and a vertical direction.

A first shutter plate 126, which is moved in the vertical direction by a first actuator 124, is disposed on the side of the first side jogger 118 opposite to the sheet discharge platform 76. When the first shutter plate 126 is lowered and faces the first side jogger 118, the first shutter plate 126 can close the plurality of air vents 122 formed at the first side jogger 118.

Figure 5:
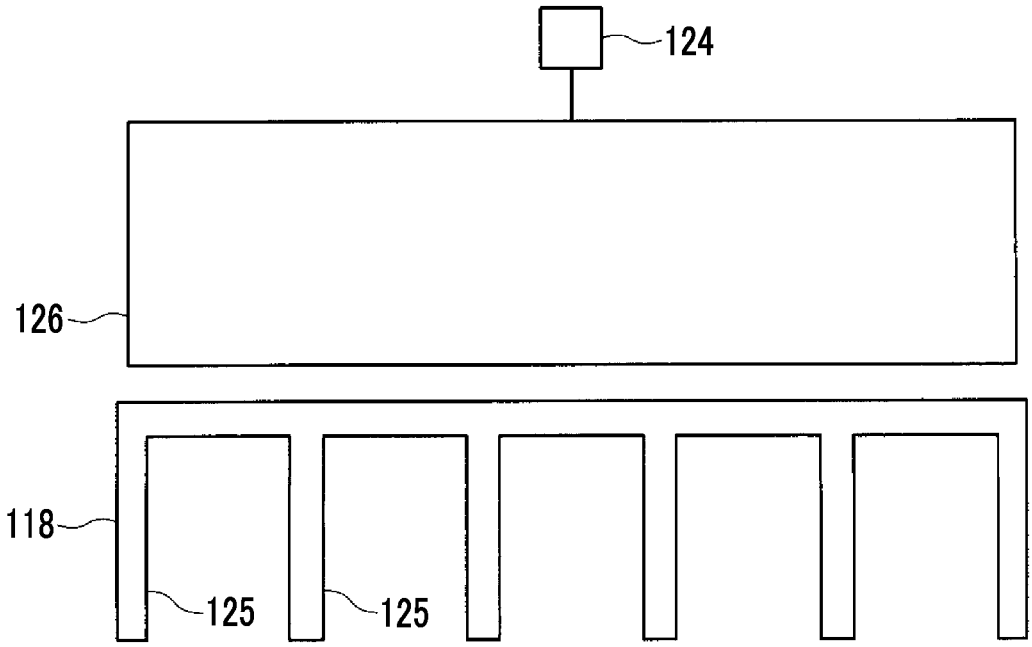
FIG. 5 is a front view showing another embodiment of the first side jogger.

Meanwhile, the shape of the air vent 122 is not limited to a circular shape, and may be other shapes, such as a rectangular shape, a polygonal shape, and the shape of a slit. Further, a plurality of air vent notches 125 may be formed as shown in FIG. 5. When the first shutter plate 126 is lowered even though a first side jogger 118 where the plurality of notches 125 are formed is used, the first shutter plate 126 can close the plurality of notches 125 formed at the first side jogger 118.

As shown in FIG. 3, a second side jogger 128 with which an end portion of the image forming sheet P to be stacked on the sheet discharge platform 76 comes into contact is mounted on the second side wall frame 116 of the sheet discharge platform 76. Meanwhile, the second side jogger 128 has the same structure as the first side jogger 118.

Figure 6A:
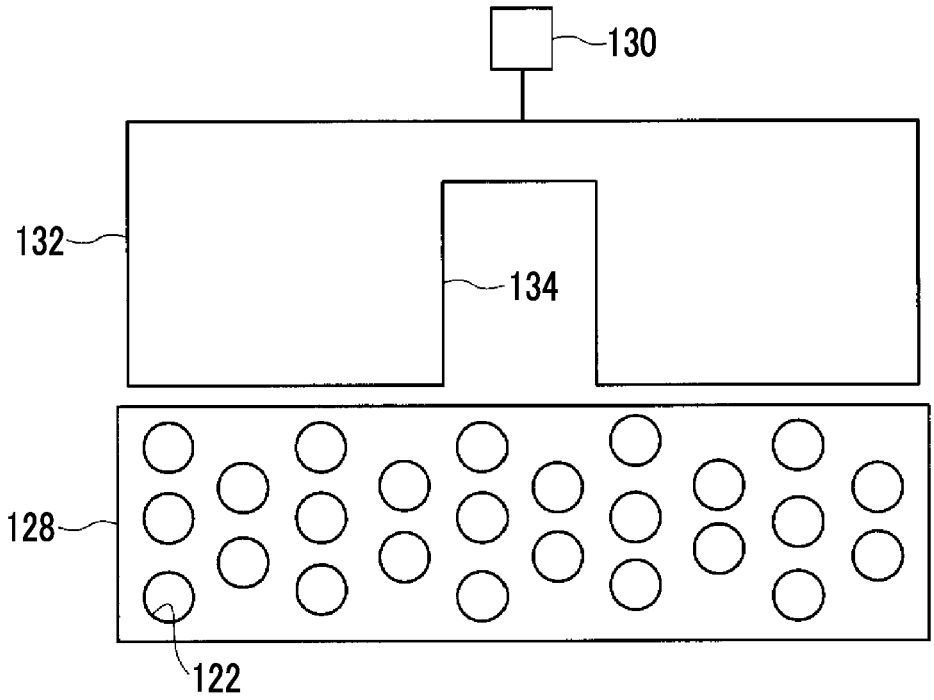
FIG. 6A is a front view of a second side jogger and a second shutter.

As shown in FIG. 6A, a second shutter plate 132, which is moved in the vertical direction by a second actuator 130, is disposed on the side of the second side jogger 128 opposite to the sheet discharge platform 76. The second shutter plate 132 is formed so as to have substantially the same size as the second side jogger 128, and an air vent notch 134 is formed in a middle portion of the second shutter plate 132 in a longitudinal direction.

Figure 6B:
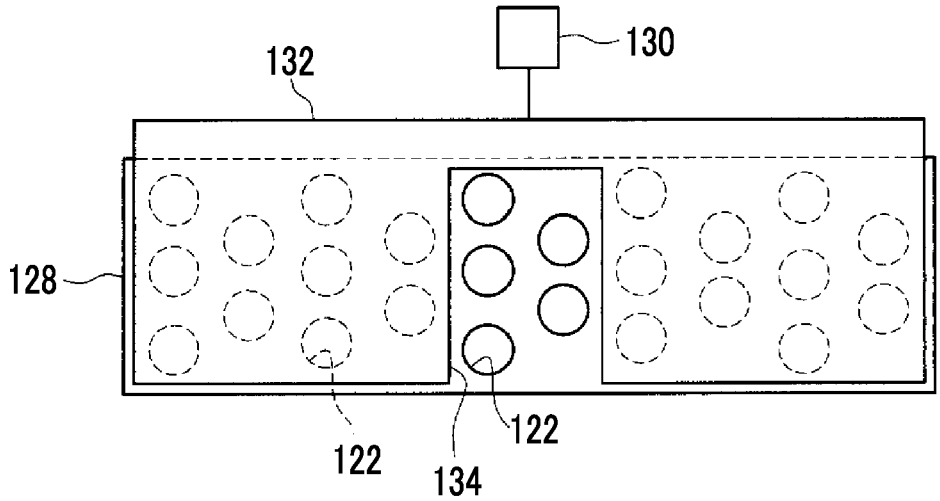
FIG. 6B is a front view showing a state in which some air vents of the second side jogger are closed by the second shutter.

When the second shutter plate 132 is lowered as shown in FIG. 6B, the air vents 122, which are formed in the middle portion of the second side jogger 128 in the longitudinal direction and face the notch 134, among the plurality of air vents 122 formed at the second side jogger 128 are not closed and the air vents 122, which do not face the notch 134, are closed.

Meanwhile, when the image forming sheet P placed on the sheet discharge platform 76 is pressed by the first side jogger 118, the end portion of the image forming sheet P can be made to come into contact with the second side jogger 128.

As shown in FIG. 3, a first support member 138 and a second support member 140, which are provided across the first and second side wall frames 114 and 116, are provided on the side of the sheet discharge platform 76 opposite to the side indicated by the arrow A.

A light-reflection type photoelectric sensor 142, which detects an upper end of a sheet bundle placed on the sheet discharge platform 76, is mounted on the first support member 138. The photoelectric sensor 142 includes: a light source, such as a light-emitting diode (LED) or a laser diode (LD), for emitting light; and a light-receiving sensor, such as a photodiode, for receiving light that is emitted from the light source and reflected by an irradiation target (image forming sheet P). The photoelectric sensor 142 is connected to the control device 88 (see FIG. 1).

The photoelectric sensor 142 is disposed above the uppermost nozzle 162 (see FIGS. 2A and 3) to be described below by a preset distance.

Meanwhile, instead of the photoelectric sensor 142, other sensors, such as a light-transmission type photoelectric sensor and an electrostatic sensor, may be used as a sensor that can detect the upper end of the sheet bundle.

A shaft 146, of which both end portions are rotatably supported by the first side wall frame 114 and the second side wall frame 116, is disposed on the side of the first support member 138 opposite to the side indicated by the arrow A.

A plurality of (in this embodiment, four) front joggers 148 coming into contact with an end portion, which is opposite to the side indicated by the arrow A, of the image forming sheet P stacked on the sheet discharge platform 76 are disposed on the shaft 146 at intervals in a longitudinal direction of the shaft 146. Upper ends of the front joggers 148 are fixed to the shaft 146, and the front joggers 148 extend downward from the shaft 146. Meanwhile, knobs 149, which are used to move the front joggers 148 in a direction in which the front joggers 148 are away from the sheet, are mounted on both end portions of the shaft 146.

A first bevel gear 150 is mounted on the middle portion of the shaft 146 in the longitudinal direction. A motor 154 is mounted on the first support member 138. Meanwhile, the motor 154 is connected to the control device 88 and is controlled. A second bevel gear 156 is mounted on a rotating shaft of the motor 154, and the second bevel gear 156 meshes with the first bevel gear 150. For this reason, when the motor 154 is driven, the shaft 146 is rotated and can oscillate the front joggers 148. Accordingly, an end portion of the image forming sheet P placed on the sheet discharge platform 76 is pressed by the front joggers 148, so that the opposite end portion of the image forming sheet P can be made to come into contact with the sheet back guide 108B.

A blowing mechanism 158 is provided on the side of the sheet discharge platform 76 opposite to the side indicated by the arrow A.

The blowing mechanism 158 of this embodiment includes two blowers 160 that are connected to the control device 88 shown in FIG. 1 and are controlled. As shown in FIGS. 2A and 3, each of the blowers 160 includes a total of six nozzles 162 that form two columns in the lateral direction and three rows in the vertical direction.

The nozzle 162 extends horizontally toward the sheet discharge platform 76, and air is blown horizontally from the end of the nozzle 162 in a direction of the arrow A. An opening, which is formed at the end of each nozzle 162 of this embodiment, has a rectangular shape that is elongated in the direction of the arrow R and the direction of the arrow L; and all of the openings of the nozzles 162 have the same shape.

Meanwhile, the lower ends of the above-mentioned front joggers 148, the lower end of the first side jogger 118, and the lower end of the second side jogger 128 are positioned below the lowermost nozzle 162.

According to the above-mentioned structure, when images are to be formed on the surfaces of the image forming sheets P, image forming sheets P loaded on the sheet feed platform 30 are lifted from the top one by one by the sucker device 32 and are fed to the sheet feed roller 34 in the sheet feed section 12 as shown in FIG. 1. The image forming sheet P fed to the sheet feed roller 34 is sent to the conveying belt 36 and is placed on the conveying belt 36.

The image forming sheet P placed on the conveying belt 36 is conveyed by the conveying belt 36 that rotates. Further, while being conveyed, the image forming sheet P is pressed against the conveying surface of the conveying belt 36 by the retainers 36B. Accordingly, the irregularity of the image forming sheet is corrected. When an end of the image forming sheet P conveyed by the conveying belt 36 comes into contact with the front stopper member 38, the inclination of the image forming sheet P is corrected. After that, the image forming sheet P is delivered to the sheet feed drum 40. Then, the image forming sheet P is conveyed to the treatment liquid applying section 14 by the sheet feed drum 40.

In the treatment liquid applying section 14, the image forming sheet P delivered from the sheet feed drum 40 is received by the treatment liquid applying drum 42. When the treatment liquid applying drum 42 holds the end portion of the image forming sheet P by the gripper 42A and rotates, the treatment liquid applying drum 42 winds the image forming sheet P on the peripheral surface thereof and conveys the image forming sheet P. While the image forming sheet P is conveyed by the treatment liquid applying drum 42, the applying roller 44A is pressed against the surface of the image forming sheet P and the treatment liquid is applied to the surface of the image forming sheet P (treatment liquid applying step).

In the treatment liquid drying section 16, the image forming sheet P delivered from the treatment liquid applying drum 42 is received by the treatment liquid drying drum 46. When the treatment liquid drying drum 46 holds the end portion of the image forming sheet P by the gripper 46A and rotates, the treatment liquid drying drum 46 conveys the image forming sheet P. In this case, the treatment liquid drying drum 46 conveys the image forming sheet P while the surface (the surface to which the treatment liquid is applied) of the image forming sheet P faces the inside.

While the image forming sheet P is conveyed by the treatment liquid drying drum 46, hot air is blown to the image forming sheet P from the treatment liquid drying processing units 50 that are installed in the treatment liquid drying drum 46. Accordingly, the image forming sheet P is subjected to drying processing (treatment liquid drying step).

In the image recording section 18, the image forming sheet P delivered from the treatment liquid drying drum 46 is received by the image recording drum 52. When the image recording drum 52 holds the end portion of the image forming sheet P by the gripper 52A and rotates, the image recording drum 52 conveys the image forming sheet P. The image forming sheet P delivered to the image recording drum 52 is made to come into close contact with the peripheral surface of the image recording drum 52 by passing through the pressing roller 54. Simultaneously, air is sucked from the suction holes of the image recording drum 52 and the image forming sheet P is held on the outer peripheral surface of the image recording drum 52 by suction.

The image forming sheet P is conveyed in this state, and passes by positions that face the recording heads 56 corresponding to the respective colors. Further, when the image forming sheet P passes by the positions facing the recording heads 56, droplets (ink liquid) are ejected to the surface of the image forming sheet P from the recording heads 56 corresponding to the respective colors. Accordingly, color images are formed on the surface of the image forming sheet P (image forming step).

The image forming sheet P on which images are formed by the recording heads 56 corresponding to the respective colors passes by a position that faces the in-line sensor 58. Further, when the image forming sheet P passes by the in-line sensor 58, information about the images formed on the surface of the image forming sheet P is read. The reading of the information about the images is performed as necessary, and an ejection failure and the like are checked from the read images. Accordingly, since it is possible to immediately detect an abnormity such as an ejection failure, it is possible to quickly cope with the abnormity.

In the ink drying section 20, the image forming sheet P delivered from the image recording drum 52 is received by the chain gripper 64. The chain gripper 64 holds the end portion of the image forming sheet P by the gripper 64B, and conveys the image forming sheet P along the suction plates 72.

The image forming sheet P delivered to the chain gripper 64 is conveyed along the first horizontal conveying path 70A. While being conveyed along the first horizontal conveying path 70A, the image forming sheet P is heated and dried by the infrared heaters 78 (droplet drying step).

In the UV irradiation processing section 22, the surface of the image forming sheet P, which is conveyed along the inclined conveying path 70B by the chain gripper 64, is irradiated with ultraviolet rays emitted from the UV irradiation units 74. Accordingly, the images formed on the image forming sheet P are subjected to UV irradiation processing and are fixed to the image forming sheet P (light irradiation step).

In the sheet discharge section 24, the image forming sheet P, which is irradiated with UV rays and is released from the gripper 64B, is stacked on the sheet discharge platform 76 and recovered. The image forming sheet P, which has been subjected to a series of processing for recording images as described above, is stacked on the sheet discharge platform 76 and recovered.

Next, the structure of the ink drying section 20 and the like will be described in detail.

As shown in FIG. 1, the suction plate 72 includes a box-like housing 80 that includes a plurality of suction holes and discharge holes formed on the outer peripheral surface thereof and the above-mentioned fans 82 that generate a suction force on the suction surface 72A (the surface facing the chain gripper 64) of the housing 80.

According to this structure, the back of the image forming sheet P, which is conveyed while an end portion of the image forming sheet P is held by the gripper 64B of the chain gripper 64, is sucked into the suction surface 72A. Accordingly, since the image forming sheet is conveyed while coming into slide contact with the suction surfaces 72A of the suction plates 72, tension, which pulls the image forming sheet P in the conveying direction of the image forming sheet P, is generated on the image forming sheet P.

That is, a tension applying device 86 as an example of tension applying means for generating tension on the image forming sheet P in the conveying direction of the image forming sheet P includes the chain gripper 64 and the suction plates 72.

Here, the suction force of the suction surface 72A and a conveying force of the chain gripper 64 are determined so that tension generated on the image forming sheet P is in the range of 100 N/m to 1000 N/m.

Further, as shown in FIG. 1, the plurality of infrared heaters 78 of the ink drying processing unit 68 are provided on the side opposite to the suction plate 72 with the image forming sheet P, which is conveyed, interposed between themselves and the suction plate 72 as described above so as to line up in the conveying direction of the image forming sheet P.

Furthermore, since the image forming sheet P is heated and dried by all of the infrared heaters 78, the output of each infrared heater 78 is determined so that the amount of water remaining in the image forming sheet P is 3 $g/m^2$ or less while tension is generated on the image forming sheet P by the tension applying device 86.

Here, the amount of remaining water is the amount of remaining water of ink, and moisture originally contained in the image forming sheet P is not considered in regard to the amount of remaining water. For example, in a case where the amount of water of ink is 10 $g/m^2$ at the time of ejection of droplets, the image forming sheet P is dried so that the amount of water of ink is reduced to 3 $g/m^2$ or less.

Meanwhile, for example, the grain direction of the image forming sheet P, which is used for the image forming apparatus 10 of this embodiment, is orthogonal to the conveying direction of the image forming sheet P. That is, tension in a direction orthogonal to the grain direction is applied to the image forming sheet P. Here, the grain direction means a direction in which paper fiber lines up.

Meanwhile, although not shown, the image forming apparatus 10 includes ink storage tanks that supply ink liquid to the respective recording heads 56C, 56M, 56Y, and 56K, means for supplying treatment liquid to the treatment liquid applying section, a head maintenance section that performs the cleaning (the wiping, purge, nozzle suction, and the like for a nozzle face) of each of the recording heads 56C, 56M, 56Y, and 56K, position detection sensors that detects the positions of the image forming sheet P on medium conveying paths, temperature sensors that detect the temperatures of the respective sections of the apparatus, and the like in addition to the above-mentioned structures. The ink storage tanks, the means for supplying treatment liquid, the head maintenance section, the position detection sensors, the temperature sensors, and the like are connected to the control device 88.

Meanwhile, a display device 90 that can display the kind of the image forming sheet P, the state of the apparatus, and the like; an operation panel 92 that is used to perform various operations of the apparatus; and the like are further connected to the control device 88 (see FIG. 1).

The weight and the thickness of each kind of the image forming sheet P (per sheet) are stored in the control device 88 in advance. When the kind of the image forming sheet P is selected using the operation panel 92, the control of the respective sections is performed according to the image forming sheet P by the control device 88. Meanwhile, the details of the control will be described below.

(Operation and Effects)

Next, the operation and effects of the image forming apparatus 10 of this embodiment will be described.

As shown in FIG. 1, the image forming sheet P fed from the sheet feed section 12 is conveyed along the outer peripheral surfaces of the sheet feed drum 40 and the treatment liquid applying drum 42 that are rotating.

In the treatment liquid applying section 14, the treatment liquid applying unit 44 applies treatment liquid (ink aggregating treatment liquid) to the recording surface (coating layer) of the image forming sheet P that is conveyed along the outer peripheral surface of the treatment liquid applying drum 42.

Moreover, the image forming sheet P to which the treatment liquid is applied is conveyed along the outer peripheral surface of the treatment liquid drying drum 46 and is heated and dried.

In the image recording section 18, the recording heads 56C, 56M, 56Y, and 56K corresponding to the respective colors form images on the image forming sheet P by ejecting droplet (ink liquid) to the recording surface (coating layer) of the image forming sheet P that is conveyed by the image recording drum 52. In this case, ink comes into contact with the treatment liquid that is applied to the recording surface in advance in the treatment liquid applying section 14, pigments and resin particles dispersed in the ink aggregate, and an aggregate is then formed. Accordingly, the flows of the pigments and the like on the image forming sheet P are prevented and images are formed on the recording surface of the image forming sheet P.

Further, the image forming sheet P where images are formed on the recording surface is conveyed to the ink drying section 20. In the ink drying section 20, the recording surface of the image forming sheet P is heated by the infrared heaters 78 so that moisture contained in the image forming sheet P after the ejection of the ink liquid is dried (the amount of moisture contained in a solvent separated by an aggregation action is reduced).

Furthermore, the image forming sheet P, which is heated and dried, is conveyed to the UV irradiation processing section 22. In the UV irradiation processing section 22, the images formed using ink are cured by ultraviolet rays emitted from the UV irradiation unit 74 and are fixed to the image forming sheet P.

The image forming sheet P to which the images have been completely fixed is discharged to the sheet discharge platform 76.

In the image forming apparatus 10 of this embodiment, a preset image forming sheet P to be used is selected from plural kinds of image forming sheets P by the operation of the operation panel 92 before the formation of the images.

The control device 88 controls the respective devices on the basis of various setting values corresponding to the selected image forming sheet P.

The operation of the sheet discharge section 24 will be described in detail below with reference to FIGS. 1 to 6B.

Figure 7A:
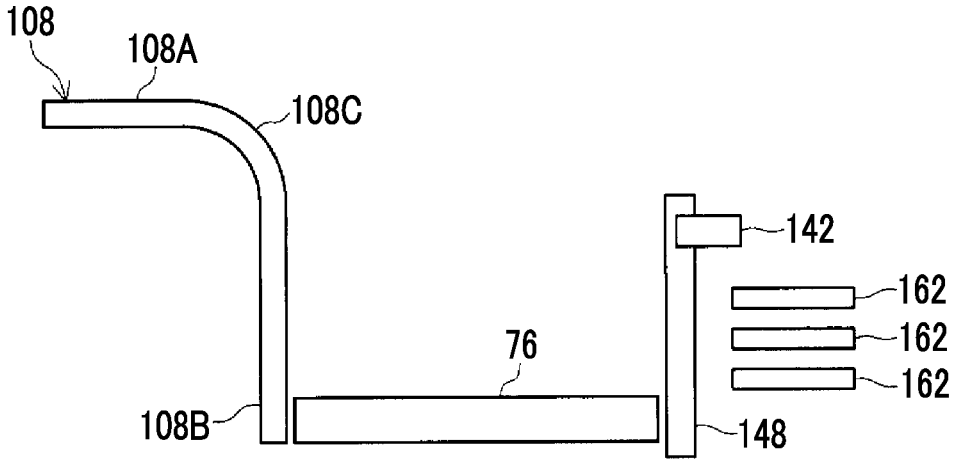
FIG. 7A is a longitudinal sectional view of the sheet stacking device of which a sheet feed platform is in an initial state.

(1) Before an image forming sheet P is loaded first, the control device 88 controls the sheet discharge platform raising and lowering device 100 so that the upper surface of the sheet discharge platform 76 is disposed at a position below the lowermost nozzle 162 by a preset distance as shown in FIG. 7A.

(2) When an image forming sheet P, which has been subjected to heating and drying processing, is discharged to the sheet discharge platform 76, the side jogger driving mechanism 120 and the motor 154 are controlled by the control device 88 and end portions of the image forming sheet P are pressed by the first side jogger 118 and the front joggers 148. Accordingly, the image forming sheet P is pressed against the second side jogger 128 and the sheet back guide 108B of the guide plate 108. Whenever an image forming sheet P is stacked, end portions of the image forming sheet P are pressed by the first side jogger 118 and the front joggers 148. Accordingly, the image forming sheet P is stacked while being aligned.

Here, when image forming sheets P are loaded at first, air is slightly blown from the nozzles 162 of the blowers 160. The flow rate of air blown in this case is stored in the control device 88 in advance. Meanwhile, since weight applied to lower image forming sheets P is relatively small when image forming sheets P are loaded at first, blocking does not occur.

(3) When the thickness of image forming sheets P sequentially discharged onto a sheet bundle reaches a preset value (for example, 1 mm) after an upper end of the sheet bundle is detected by the photoelectric sensor 142, the control device 88 controls the sheet discharge platform raising and lowering device 100 so that the sheet discharge platform 76 is lowered by a preset distance (for example, 1 mm). The preset value is a value that is obtained by multiplying the thickness of the image forming sheet P, which is stored in the control device 88, by the number of discharged image forming sheets P; and the calculation of the preset value is performed by the control device 88. Accordingly, the upper end of the sheet bundle is kept at a certain position.

(4) When image forming sheets P are stacked and the height of the sheet bundle is increased as shown in FIG. 2A, a control for increasing the flow rate of air to be blown from the nozzles 162 of the blowers 160 is performed by the control device 88 and air passes between the image forming sheets P positioned in front of the openings of the nozzles 162 so that a gap is formed between the image forming sheets P. Accordingly, the plurality of image forming sheets P, which face the openings of the nozzles 162, can be simultaneously and efficiently cooled.

Air, which has passed between the image forming sheets P of the sheet bundle, is discharged to the outside of the sheet discharge section 24 through the openings 112 (see FIG. 3) that are formed at the sheet back guide 108B of the guide plate 108.

Meanwhile, the control device 88 can calculate the height of a sheet bundle from the thickness of the image forming sheet P and the number of the stacked image forming sheets P and determine a time when the flow rate of air to be blown is to be increased. When the control device 88 increases the flow rate of air to be blown, the control device 88 controls the flow rate of air to be blown from the blowers 160 so that an image forming sheet P, which is positioned above the opening of the nozzle 162 of the uppermost nozzle 162, does not flutter. The flow rate of air, which is to be blown from the blowers 160 when the flow rate of air to be blown is large, is stored in the control device 88 in advance. Accordingly, when an image forming sheet P is selected, the flow rate of air to be blown corresponding to the image forming sheet P is determined.

The thickness of a sheet bundle positioned above the opening of the uppermost nozzle 162, that is, weight is kept in a certain range in this way. Accordingly, even though the sheet bundle positioned above the uppermost nozzle 162 floats due to air blown from the uppermost nozzle 162, a certain level of weight can be applied to the sheet bundle. For this reason, the fluttering of the image forming sheets P of the sheet bundle, which is positioned above the opening of the uppermost nozzle 162, can be suppressed.

In addition, since the weight of a sheet bundle, which is positioned above the opening of the uppermost nozzle 162, is kept in a certain range, weight, which is applied to the image forming surface of the image forming sheet P of the sheet bundle, is not excessively increased and the occurrence of blocking can be suppressed.

Meanwhile, in a case where the weight of a sheet bundle, which is positioned above the opening of the nozzle 162, is excessively reduced or in a case where the flow rate of air to be blown is excessively large, an image forming sheet P of the sheet bundle may flutter and the image forming sheet P may be damaged or folded.

Air is not blown to image forming sheets P, which are positioned below the opening of the lowermost nozzle 162, from the side, and an end portion of a sheet is pressed near the lower end of the lowermost nozzle 162 by the respective joggers whenever an image forming sheet P falls. Accordingly, the image forming sheet P of a sheet bundle, which is stacked below the lowermost nozzle 162, is aligned. Further, since the image forming sheet P, which is positioned below the opening of the lowermost nozzle 162, is sufficiently cooled, blocking does not occur even though large weight is applied.

In the image forming apparatus 10 of this embodiment, the image forming sheets P are efficiently cooled and the fluttering of the image forming sheets P can be suppressed as described above. Accordingly, the occurrence of blocking and the damage or folding of the image forming sheet P can be suppressed.

Meanwhile, in the image forming apparatus 10 of this embodiment, control can be changed according to the kind of the image forming sheet P.

Figure 7B:
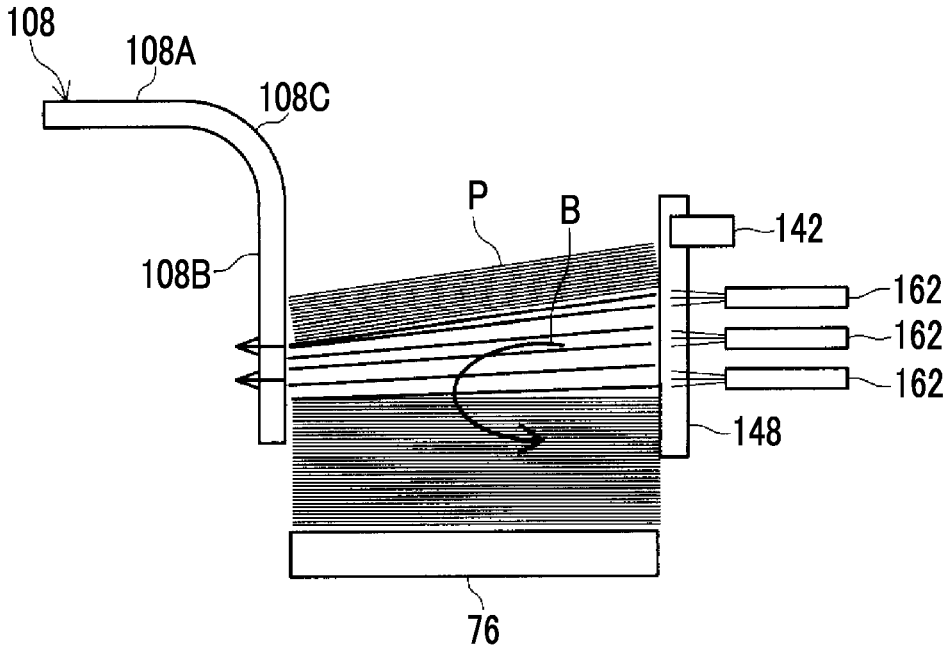
FIG. 7B is a longitudinal sectional view of the sheet stacking device showing a state in which air is discharged to the side of a sheet bundle from a middle portion of the sheet bundle.

For example, if the air vents 122 of the first side jogger 118 are not closed by the first shutter plate 126 and the air vents 122 of the second side jogger 128 are not closed by the second shutter plate 132 in a case where thick image forming sheets P are used, a part of air blown between the sheets is discharged from the air vents 122 (see FIGS. 3 and 4) before being discharged from the air vent openings 112 (see FIG. 3) of the guide plate 108 as shown by an arrow of FIG. 7B. For this reason, since the flow rate of air passing through the guide plate 108 is reduced, the performance of the cooling of the image forming sheet P may deteriorate. The reason for this is as follows: since the weight of the sheet bundle positioned above the nozzle 162 is increased in the case where thick image forming sheets P are used, intervals between the sheets near the sheet back guide 108B are reduced. As a result, air-flow resistance is increased.

In order to avoid this situation, in the case where thick image forming sheets P are used, the air vents 122 of the first side jogger 118 are closed by the first shutter plate 126 and the air vents 122 of the second side jogger 128 are closed by the second shutter plate 132 so that the leakage of air from the air vent 122 is suppressed. Accordingly, since intervals between the sheets become constant as shown in FIG. 2A, a large amount of air can be blown between the sheets. As a result, the image forming sheets P can be efficiently cooled from the nozzle to the sheet back guide 108B.

Meanwhile, in a case where thin image forming sheets P are used, the weight of a sheet bundle positioned above the nozzle 162 is reduced in contrast with the case in which thick image forming sheets P are used. Accordingly, even though the air vents 122 of the first side jogger 118 are not closed by the first shutter plate 126 and the air vents 122 of the second side jogger 128 are not closed by the second shutter plate 132, the amount of air, which leaks to the outside of the sheet discharge section 24 from the air vents 122 of the first and second side joggers 118 and 128, is small and air passes through the sheets to the guide plate 108. Therefore, since the intervals between the sheets become constant, a large amount of air can be blown between the sheets.

Figure 8A:
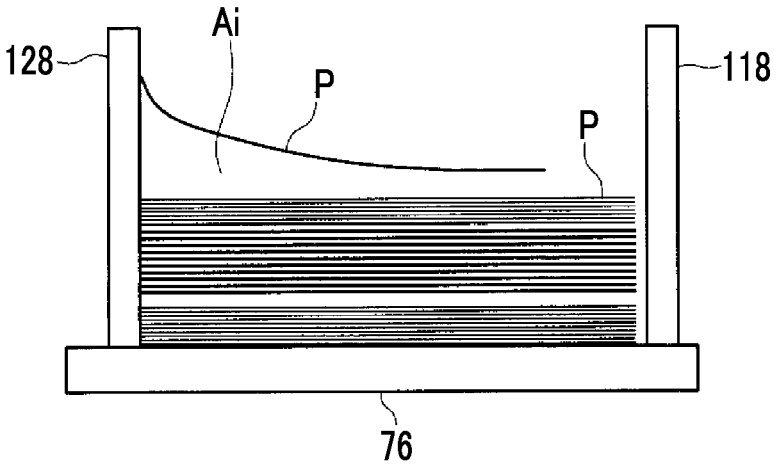
FIG. 8A is a longitudinal sectional view of the sheet stacking device showing a state in which air is accumulated between a sheet bundle and a sheet discharged onto the sheet bundle and the sheet discharged onto the sheet bundle is caught by a side jogger.

Further, when an image forming sheet P falls so as to be inclined due to variation in the discharge of sheets as shown in FIG. 8A in the case in which thin image forming sheets P are used, air Ai cannot be easily vented from beneath the image forming sheet P. Accordingly, the image forming sheet P is bent and is caught by the side surface of the second side jogger 128. For this reason, a stacking property may deteriorate.

Figure 8B:
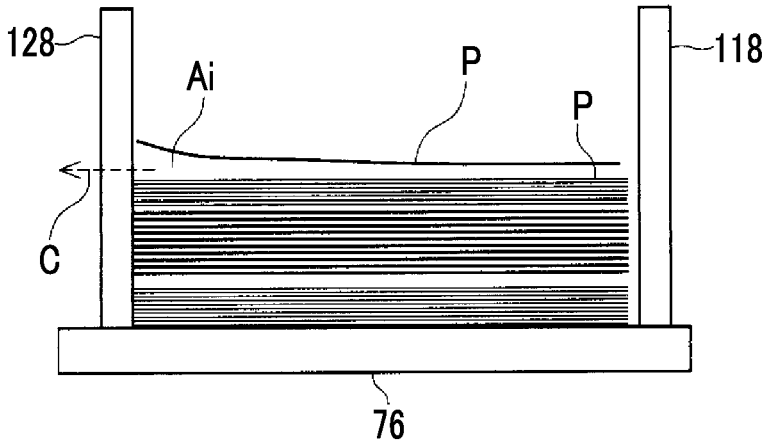
FIG. 8B is a longitudinal sectional view of the sheet stacking device showing in a state in which the air accumulated between the sheet bundle and the sheet discharged onto the sheet bundle has been discharged.

In order to avoid this situation, the air vents 122 are made not to be closed by the second shutter plate 132 (see FIGS. 6A and 6B) of the second side jogger 128. Accordingly, as shown in FIG. 8B, air Ai between the image forming sheet P, which has been already stacked, and the image forming sheet P, which has fallen, is discharged to the outside of the sheets from the air vents 122 of the second side jogger 128 in a direction of an arrow C. For this reason, even though an image forming sheet P falls so as to be inclined due to variation in the discharge of sheets, the deterioration of a stacking property, which is caused when the image forming sheet P is caught by the side surface of the second side jogger 128, can be suppressed.

Figure 9A:
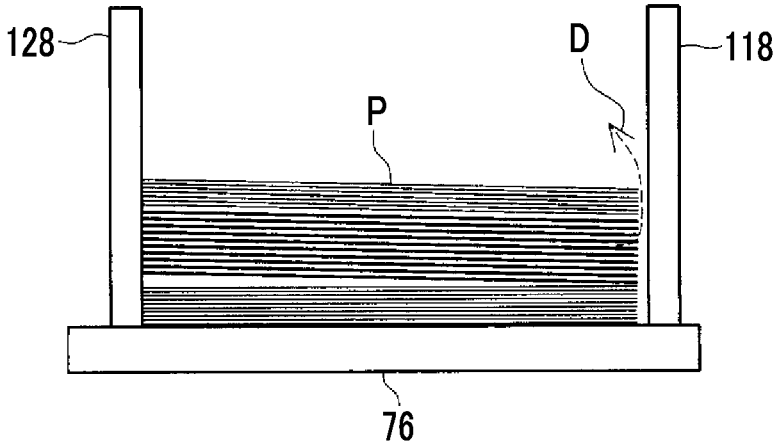
FIG. 9A is a longitudinal sectional view of the sheet stacking device showing a state in which the leakage of air from the sheet bundle is not balanced on the first side jogger and the second side jogger.

Furthermore, the first side jogger 118 may be slightly away from the side surface of the sheet bundle so that the image forming sheet P, which is discharged from the UV irradiation unit 74, smoothly falls between the first side jogger 118 and the second side jogger 128. In the case where image forming sheets P are thick, one side surface of the sheet bundle comes into close contact with the second side jogger 128, and the other side surface of the sheet bundle is slightly away from the first side jogger 118 as shown in FIG. 9A, air in the sheet bundle is discharged to the outside through a gap between the sheet bundle and the first side jogger 118 in a direction of an arrow D. For this reason, the leakage of air from the sheet bundle is not balanced on one side (the side facing the second side jogger 128) and the other side (the side facing the first side jogger 118) of the sheet bundle. As a result, an image forming sheet P may be slightly inclined so that a portion of the image forming sheet P facing the second side jogger 128 is higher than a portion thereof facing the first side jogger 118.

Figure 9B:
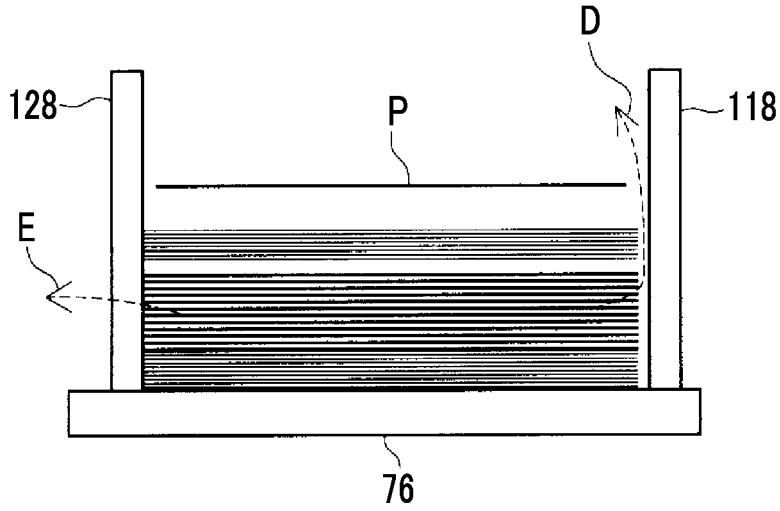
FIG. 9B is a longitudinal sectional view of the sheet stacking device showing a state in which the leakage of air from the sheet bundle is balanced on the first side jogger and the second side jogger.

In order to avoid this situation, when the air vents 122 of the second side jogger 128 are not closed and air between the sheets at a position close to the second side jogger 128 is discharged from the air vents 122 in a direction of an arrow E as shown in FIG. 9B, the leakage of air from the sheet bundle is balanced on the side of the sheet bundle facing the first side jogger 118 and the side thereof facing the second side jogger 128. Accordingly, the inclination of the image forming sheet P can be suppressed.

Figure 10A:
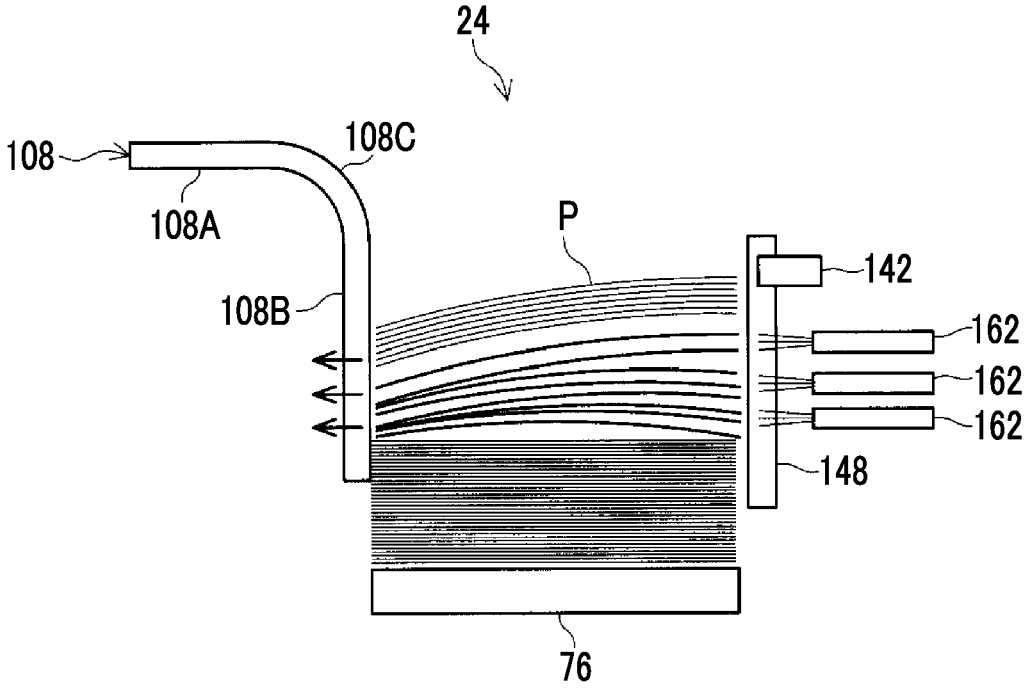
FIG. 10A is a longitudinal sectional view of the sheet stacking device showing a state in which curved sheets are stacked.

In addition, since intervals between the sheets are not constant as shown in FIG. 10A when thick image forming sheets P having curled are discharged and stacked, air cannot easily pass between the sheets.

Figure 10B:
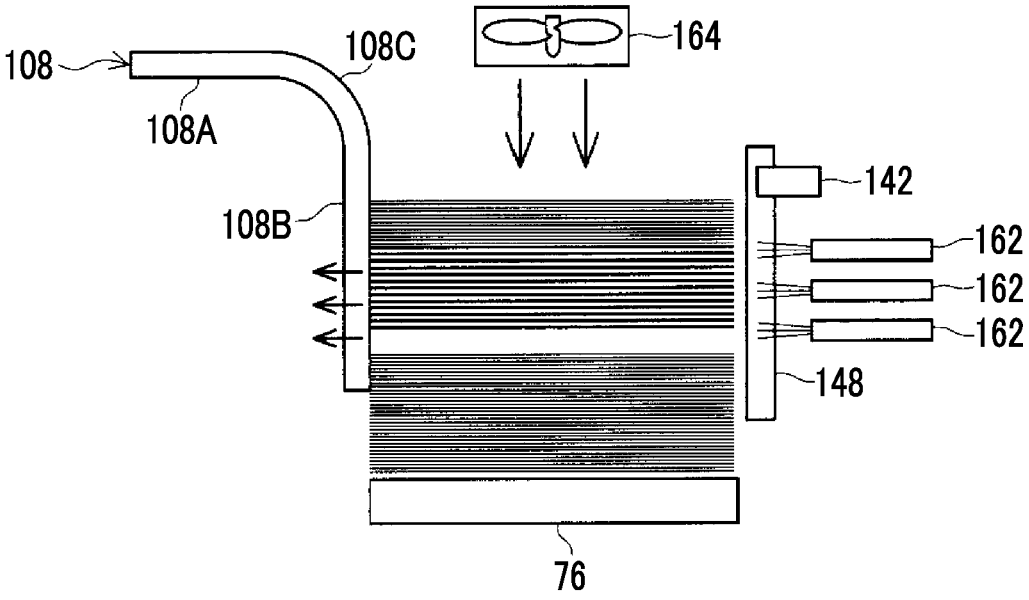
FIG. 10B is a longitudinal sectional view of the sheet stacking device showing a state in which curved sheets are corrected by a fan.

In order to avoid this situation, an upper fan 164, which blows air to the lower side, is disposed above the sheet discharge platform 76 to apply wind pressure, which acts downward, to the upper image forming sheet P as shown in FIG. 10B.

Accordingly, the curl of the stacked image forming sheet P is corrected. As a result, it is possible to allow air, which is blown from the nozzles 162, to efficiently pass between the sheets.

EXAMPLES

Test Example 1

Tests were performed to find out an influence of the height of a nozzle at the time of blowing on a sheet-cooling temperature, the occurrence of blocking, and the fluttering of a sheet. Test conditions are as follows:

a. Sheet: ibest W (manufactured by Nippon Paper Industries Co., Ltd.), the weighing capacity of the sheet: 310 gsn, the thickness of the sheet: 0.34 mm, the size of sheet: 750 mm×530 mm.

b. The number of printed sheets: 1000 c. The temperature of the sheet: the sheet is discharged to the sheet discharge platform at 55° C.

d. External environment: room temperature: 23° C., humidity: 50% RH.

Figure 11A:
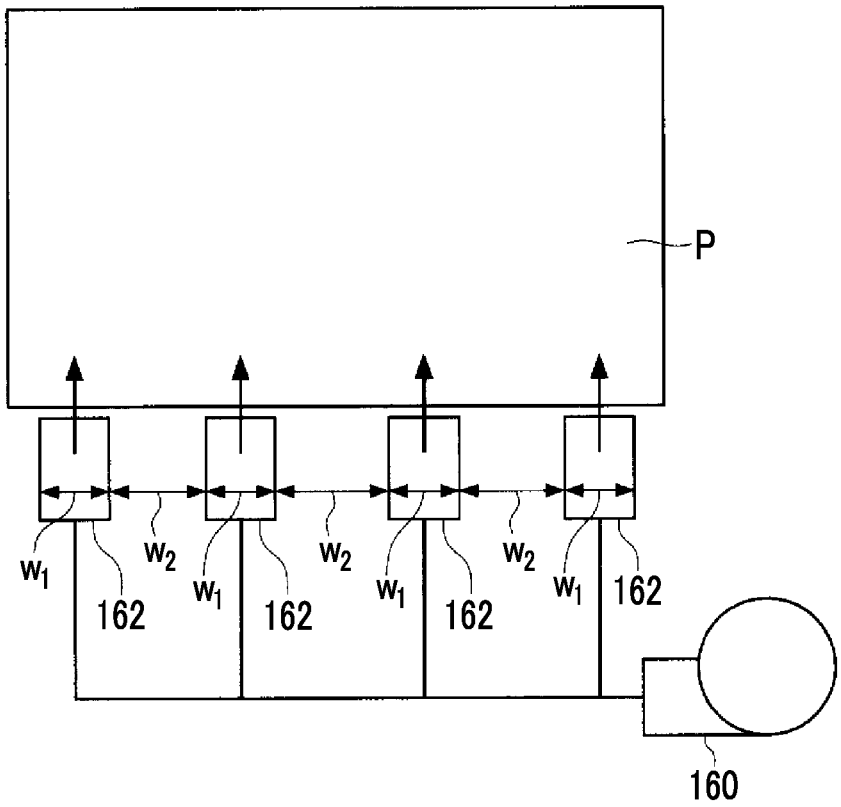
FIG. 11A is a plan view showing the disposition of nozzles of a sheet stacking device according to an example.
Figure 11B:
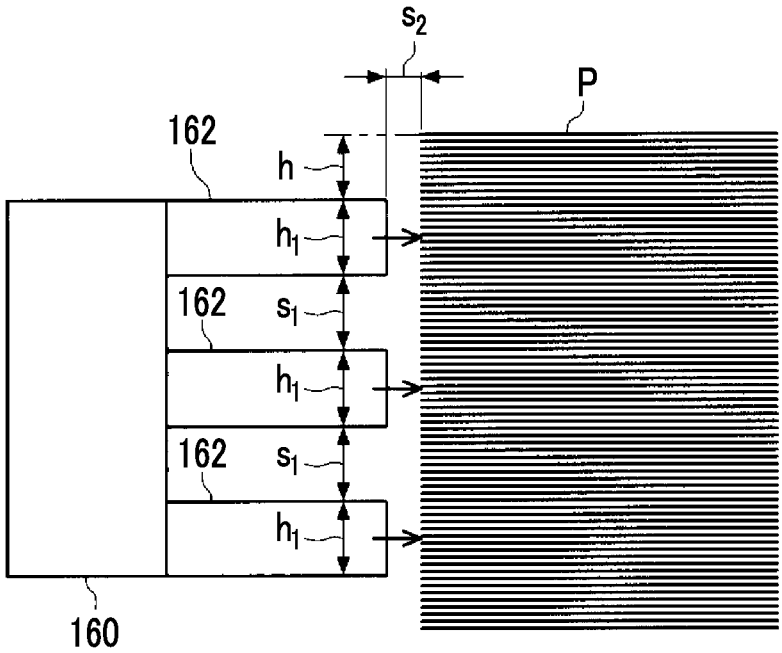
FIG. 11B is a side view showing a positional relationship between a sheet bundle and the nozzles in a height direction.

As shown in FIGS. 11A and 11B, a total of twelve nozzles 162 forming four columns in the lateral direction and three rows in the vertical direction were disposed. The height $h_1$ of the opening of the nozzle 162 was set to 5 mm, an interval $s_1$ between the openings of the nozzles 162 in the vertical direction was set to 5 mm, the width $w_1$ of the opening of the nozzle 162 was set to 60 mm, and an interval $w_2$ between the openings of the nozzles 162 in the lateral direction was set to 20 mm.

Further, an interval $s_2$ between an end of the nozzle 162 and a sheet bundle was set to 1 mm.

Meanwhile, a distance h between an upper end of the opening of the uppermost nozzle 162 and an upper end of the sheet bundle in the vertical direction was changed in the range of 0 mm to 30 mm.

A blower 160, of which static pressure is 1670 Pa and the maximum flow rate is 33 $m^3$/min, was used to equally distribute air to the respective nozzles 162.

Evaluation Indexes are as Follows:

e. Sheet-cooling temperature: a thermocouple was inserted into a cooled sheet bundle to measure the temperature of a sheet in three stages A to C.

A: The temperature of a sheet≤40° C.

B: 40° C.<the temperature of a sheet≤45° C.

C: 45° C.<the temperature of a sheet f. Blocking: solid images were formed on both of the entire surfaces of each of sheets and whether or not blocking (image peeling) occurred was visually evaluated in three stages A to C while the sheets were turned over after the sheets were left overnight.

A: Blocking did not occur

B: Blocking slightly occurred (image peeling slightly occurred but there was no practical problem)

C: Blocking occurred g. Fluttering of sheet: whether or not the fluttering of a sheet occurred during blowing was visually evaluated in three stages A to C.

A: Fluttering did not occur

B: Fluttering slightly occurred but there was no practical problem

C: Fluttering significantly occurred and a sheet was damaged or folded

Evaluation results are as shown in the following Table 1.

TABLE 1

<Evaluation results>

| Conditions | h (mm) | Sheet-cooling temperature | Blocking | Fluttering of sheet |
|---|---|---|---|---|
| Condition 1 | 0 | A | A | C |
| Condition 2 | 2 | A | A | C |
| Condition 3 | 4 | A | A | B |
| Condition 4 | 6 | A | A | A |
| Condition 5 | 8 | A | A | A |
| Condition 6 | 12 | A | A | A |
| Condition 7 | 16 | A | A | A |
| Condition 8 | 20 | B | B | A |
| Condition 9 | 25 | C | C | A |
| Condition 10 | 30 | C | C | A |

Figure 12:
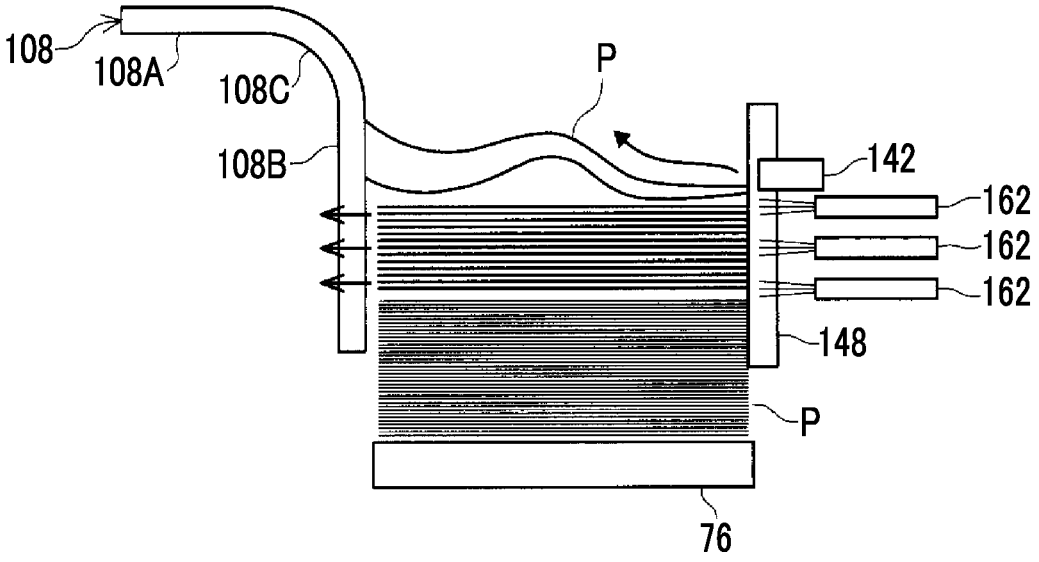
FIG. 12 is a longitudinal sectional view of the sheet stacking device showing an aspect in which a top sheet flutters.

Specific form of Condition 2: see FIG. 12. Since a sheet vibrates in the vertical direction to some extent in a blowing zone, air passes above a top sheet. Accordingly, the top sheet flutters.

Specific form of Condition 5: see FIG. 2A. A sheet does not flutter.

Figure 13:
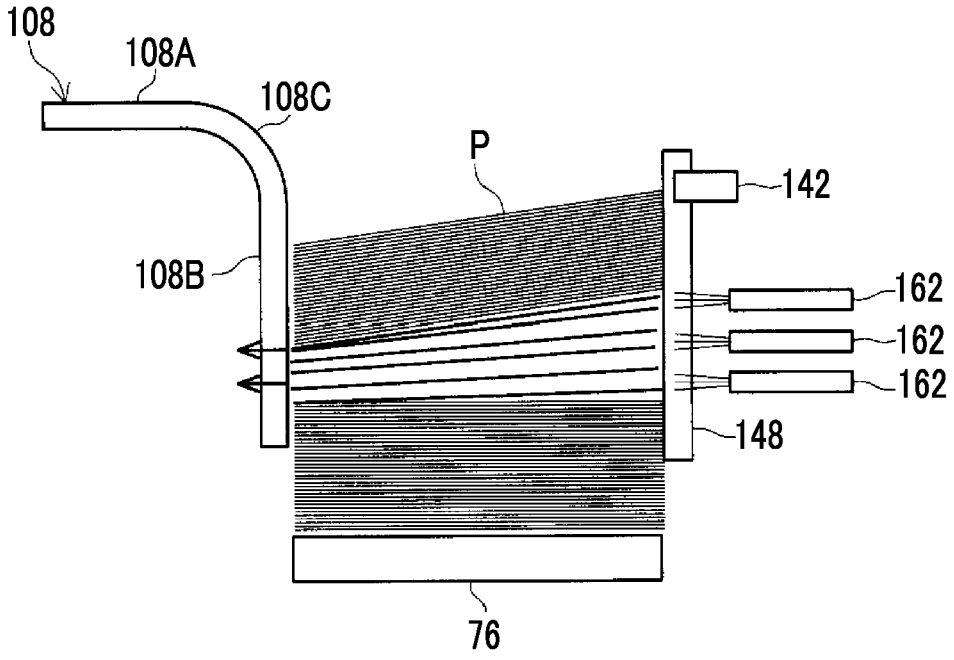
FIG. 13 is a longitudinal sectional view of the sheet stacking device showing a state in which a sheet less floats at a position close to a back guide.

Specific form of Condition 9: see FIG. 13. A sheet less floats near the sheet back guide 108B and cooling efficiency is low.

As a result of the test, it was found as follows: when a distance h between an upper end of the opening of the uppermost nozzle 162 and an upper end of a sheet bundle in the vertical direction was set in the range of 4 mm to 20 mm, there was no practical problem in cooling a sheet and the occurrence of blocking and the fluttering of a sheet were also suppressed to a level in which there was no practical problem.

Test Example 2

The change of the performance of the cooling of a sheet and the change of the posture of a sheet were tested according to a relationship between the opening/closing of the air vents 122 of the first and second side joggers and the thickness of a sheet. Test conditions are as follows The test example 2 was performed under the same conditions as the test example 1 except that a distance h between an upper end of the opening of the uppermost nozzle 162 and an upper end of a sheet bundle in the vertical direction was set to 12 mm and the shutter 126 was opened and closed.

a. Sheet cooling performance: a thermocouple was inserted into a cooled sheet bundle to measure the temperature of a sheet in three stages A to C.

A: The temperature of a sheet≤40° C.

B: 40° C.<the temperature of a sheet≤45° C.

C: 45° C.<the temperature of a sheet b. Stacking accuracy: the posture of a stacked sheet was visually evaluated in three stages A to C.

A: The variation of the position of an edge of a sheet was smaller than 1 mm.

B: The variation of the position of an edge of a sheet was 1 mm or more and smaller than 3 mm (there was no practical problem).

C: The variation of the position of an edge of a sheet was 3 mm or more.

Evaluation results are as shown in the following Table 2.

TABLE 2

Relationship between the opening/closing of shutter with respect to side jogger, thickness of sheetsheet cooling performance, and stacking accuracy

| Open/closed state of shutter | Sheet | Sheet cooling performance | Stacking accuracy |
|---|---|---|---|
| Open | ibest W 310 gsm (0.34 mm) | B | A |
| Closed | OK Top Coat Plus 104.7 gsm (0.09 mm) | A | B |

Other Embodiments

An embodiment of the invention has been described above, but the invention is not limited to the embodiment and it goes without saying that the invention may include various embodiments without departing from the scope of the invention.

In the above-mentioned embodiment, the photoelectric sensor 142 has been used to directly detect the position of the upper end of the sheet bundle. However, alternatively, the upper end of the sheet bundle may be directly detected.

For example, a weight sensor is provided on the sheet discharge platform 76, and the height of the sheet bundle can be calculated by the control device 88 on the basis of the weight of an image forming sheet P, which is detected by the weight sensor, and weight and thickness per image forming sheet P that are known in advance.

In the above-mentioned embodiment, a distance h between an upper end of the uppermost nozzle 162 and an upper end of a sheet bundle in the vertical direction has been kept constant by the change of the height position of the sheet discharge platform 76. However, the invention is not limited thereto, and in the invention, an actuator, which moves in the vertical direction, may be connected to the blower 160 and the position of the nozzle 162 may be raised with an increase in the height of the sheet bundle, so that the distance h in the vertical direction may be kept constant.

Two blowers 160 have been used in the blowing mechanism 158 of the embodiment, but the number of blowers 160 is not limited to two. In the invention, a blower may be provided for each of the twelve nozzles 162 and air blown from one blower 160 may be distributed to the twelve nozzles 162.

When the blower 160 is provided for each of the nozzles, for example, SanAce B97 (of which the maximum static pressure is 1280 Pa and the maximum flow rate is 1.61 $m^3$/min) manufactured by Sanyo Denki Co., Ltd. can be used. When air blown from one blower 160 is distributed to the respective nozzles 162, for example, EM-125M2 (of which the maximum static pressure is 1670 Pa and the maximum flow rate is 33 $m^3$/min) manufactured by Showa Denki Co., Ltd. can be used as the blower 160.

In order to ensure a flow rate that allows an image forming sheet P to sufficiently float, static pressure is preferably 500 Pa or more and more preferably 1000 Pa or more. Further, in order to sufficiently cool an image forming sheet P, a flow rate is preferably 8 $m^3$/min or more and more preferably 15 $m^3$/min or more.

Meanwhile, air has been blown to a stacked image forming sheet P to cool the image forming sheet P in the above-mentioned embodiment, but an image forming sheet P, which is being conveyed, may be cooled.

EXPLANATION OF REFERENCES

10: image forming apparatus
24: sheet discharge section
76: sheet discharge platform
77: sheet stacking device
88: control device
100: sheet discharge platform raising and lowering device (height adjustment mechanism)
108: back guide (sheet alignment mechanism)
118: first side jogger (sheet alignment mechanism)
120: side jogger driving mechanism (sheet alignment mechanism)
122: air vent (air passage portion)
124: first actuator (area changing device)
125: notch (air passage portion)
126: first shutter plate (area changing device)
128: second side jogger (sheet alignment mechanism)
130: second actuator (area changing device)
132: second shutter plate (area changing device)
142: photoelectric sensor (height detecting device)
146: shaft (sheet alignment mechanism)
148: front jogger (sheet alignment mechanism)
150: first bevel gear (sheet alignment mechanism)
152: mounting fitting (sheet alignment mechanism)
154: motor (sheet alignment mechanism)
156: second bevel gear (sheet alignment mechanism)
158: blowing mechanism
160: blower
162: nozzle
164: upper fan (blowing fan)

What is claimed is:

1. A sheet stacking device comprising:

a sheet discharge platform where sheets, which have been subjected to heating and drying processing after images are formed using ink liquid, are conveyed and stacked;

a blowing mechanism that includes a nozzle having an opening, a whole surface of the opening being positioned so as to face a portion on a side surface of a sheet bundle stacked on the sheet discharge platform below an upper portion of the sheet bundle by a distance corresponding to a predetermined number of sheets, and the nozzle blowing air to the side surface of the sheet bundle via the opening;

a height adjustment mechanism that changes the position of the sheet discharge platform relative to the nozzle in a vertical direction according to a height of the sheet bundle;

a height detecting device that detects the height of the sheet bundle stacked on the sheet discharge platform; and a control device that controls the height adjustment mechanism according to the height of the sheet bundle detected by the height detecting device; wherein the sheet discharge platform is fixed and the height adjustment mechanism raises the nozzle according to an increase in the height of the sheet bundle.

2. The sheet stacking device according to claim 1, wherein the blowing mechanism is provided on a downstream side of the sheet discharge platform in a conveying direction of the sheet.

3. The sheet stacking device according to claim 1, wherein the height adjustment mechanism lowers the sheet discharge platform according to an increase in the height of the sheet bundle.

4. The sheet stacking device according to claim 1, further comprising:

a sheet alignment mechanism that aligns the sheet by coming into contact with the side surface of the sheet bundle below the portion to which air is blown from the nozzle.

5. The sheet stacking device according to claim 4, wherein the sheet alignment mechanism includes a sheet alignment member that includes an air passage portion allowing air to pass therethrough and aligns the sheet of the sheet bundle by coming into contact with a side surface of the sheet bundle crossing the side surface of the sheet bundle to which air is blown, and an area changing device that changes an air passage area of the air passage portion.

6. The sheet stacking device according to claim 5, wherein the control device controls the area changing device to reduce the air passage area of the air passage portion in a case where the sheets are thick.

7. The sheet stacking device according to claim 1, further comprising:

a blowing fan that blows air to an upper surface of the sheet bundle toward a lower side.

8. The sheet stacking device according to claim 1, wherein the control device adjusts a blowing height between an upper end of an opening of the nozzle and an upper surface of the sheet bundle in the range of 4 mm to 20 mm.

9. The sheet stacking device according to claim 1, wherein the height detecting device is a weight sensor that is provided on the sheet discharge platform, and the control device calculates the height of the sheet bundle on the basis of the weight and thickness of the sheet, which are stored in advance, and the weight of the sheet bundle that is measured by the weight sensor.

10. A sheet stacking device comprising:

a sheet discharge platform where sheets, which have been subjected to heating and drying processing after images are formed using ink liquid, are conveyed and stacked;

a blowing mechanism that includes a nozzle having an opening, a whole surface of the opening being positioned so as to face a portion on a side surface of a sheet bundle stacked on the sheet discharge platform below an upper portion of the sheet bundle by a distance corresponding to a predetermined number of sheets, and the nozzle blowing air to the side surface of the sheet bundle via the opening;

a height adjustment mechanism that changes the position of the sheet discharge platform relative to the nozzle in a vertical direction according to a height of the sheet bundle;

a height detecting device that detects the height of the sheet bundle stacked on the sheet discharge platform;

a control device that controls the height adjustment mechanism according to the height of the sheet bundle detected by the height detecting device; and a sheet alignment mechanism that aligns the sheet by coming into contact with the side surface of the sheet bundle below the portion to which air is blown from the nozzle; wherein the sheet alignment mechanism includes a sheet alignment member that includes an air passage portion allowing air to pass therethrough and aligns the sheet of the sheet bundle by coming into contact with a side surface of the sheet bundle crossing the side surface of the sheet bundle to which air is blown, and an area changing device that changes an air passage area of the air passage portion.

11. The sheet stacking device according to claim 10, wherein the blowing mechanism is provided on a downstream side of the sheet discharge platform in a conveying direction of the sheet.

12. The sheet stacking device according to claim 10, wherein the height adjustment mechanism lowers the sheet discharge platform according to an increase in the height of the sheet bundle.

13. The sheet stacking device according to claim 10, wherein the sheet discharge platform is fixed and the height adjustment mechanism raises the nozzle according to an increase in the height of the sheet bundle.

14. The sheet stacking device according to claim 10, wherein the control device controls the area changing device to reduce the air passage area of the air passage portion in a case where the sheets are thick.

15. The sheet stacking device according to claim 10, further comprising:

a blowing fan that blows air to an upper surface of the sheet bundle toward a lower side.

16. The sheet stacking device according to claim 10, wherein the control device adjusts a blowing height between an upper end of an opening of the nozzle and an upper surface of the sheet bundle in the range of 4 mm to 20 mm.

17. The sheet stacking device according to claim 10, wherein the height detecting device is a weight sensor that is provided on the sheet discharge platform, and the control device calculates the height of the sheet bundle on the basis of the weight and thickness of the sheet, which are stored in advance, and the weight of the sheet bundle that is measured by the weight sensor.

* * * * *